US005429111A

United States Patent [19]

Akamatsu

[11] Patent Number: 5,429,111

[45] Date of Patent: Jul. 4, 1995

[54] GAS BURNING APPARATUS

[75] Inventor: Yoshio Akamatsu, Nara, Japan

[73] Assignee: Matsushita Electric Industrial Co., Ltd., Osaka, Japan

[21] Appl. No.: 36,693

[22] Filed: Mar. 25, 1993

[30] Foreign Application Priority Data

Mar. 26, 1992 [JP] Japan ..... 4-068041

[51] Int. Cl.[6] ..... F24C 3/00

[52] U.S. Cl. ..... 126/52; 126/39 BA; 126/39 C; 126/39 E; 126/39 G

[58] Field of Search ..... 431/89, 90, 12, 75; 219/497; 126/39 BA, 39 G, 39 C, 39 E, 52; 236/1 A, 1 E, DIG. 8

[56] References Cited

U.S. PATENT DOCUMENTS 5,099,108 3/1992 Kimura et al. .

FOREIGN PATENT DOCUMENTS

0043256A1 6/1980 European Pat. Off. .
0245068A2 5/1987 European Pat. Off. .
55-063317 5/1980 Japan .
56-021210 2/1981 Japan .
57-084926 5/1982 Japan .
62-037614 2/1987 Japan .
62-248926 10/1987 Japan .
63-003271 1/1988 Japan .
1146285 6/1989 Japan .
1-252851 10/1989 Japan .
2-093206 4/1990 Japan .
3279747 12/1991 Japan .
2121520 6/1983 United Kingdom .

*Primary Examiner*—Larry Jones
*Attorney, Agent, or Firm*—Wenderoth, Lind & Ponack

[57] ABSTRACT

A gas burning apparatus detects a gas pressure existing between a nozzle for supplying gas to a burner and an adjusting valve for adjusting combustion amount by means of a pressure sensor. A central control device, including a microcomputer, drives the adjusting valve so as to obtain a combustion amount desired by a user. This construction controls thermal power accurately. In addition, a different kind of gas stored by the microcomputer can be used by operating a switch corresponding to the kind of gas to be used.

23 Claims, 26 Drawing Sheets

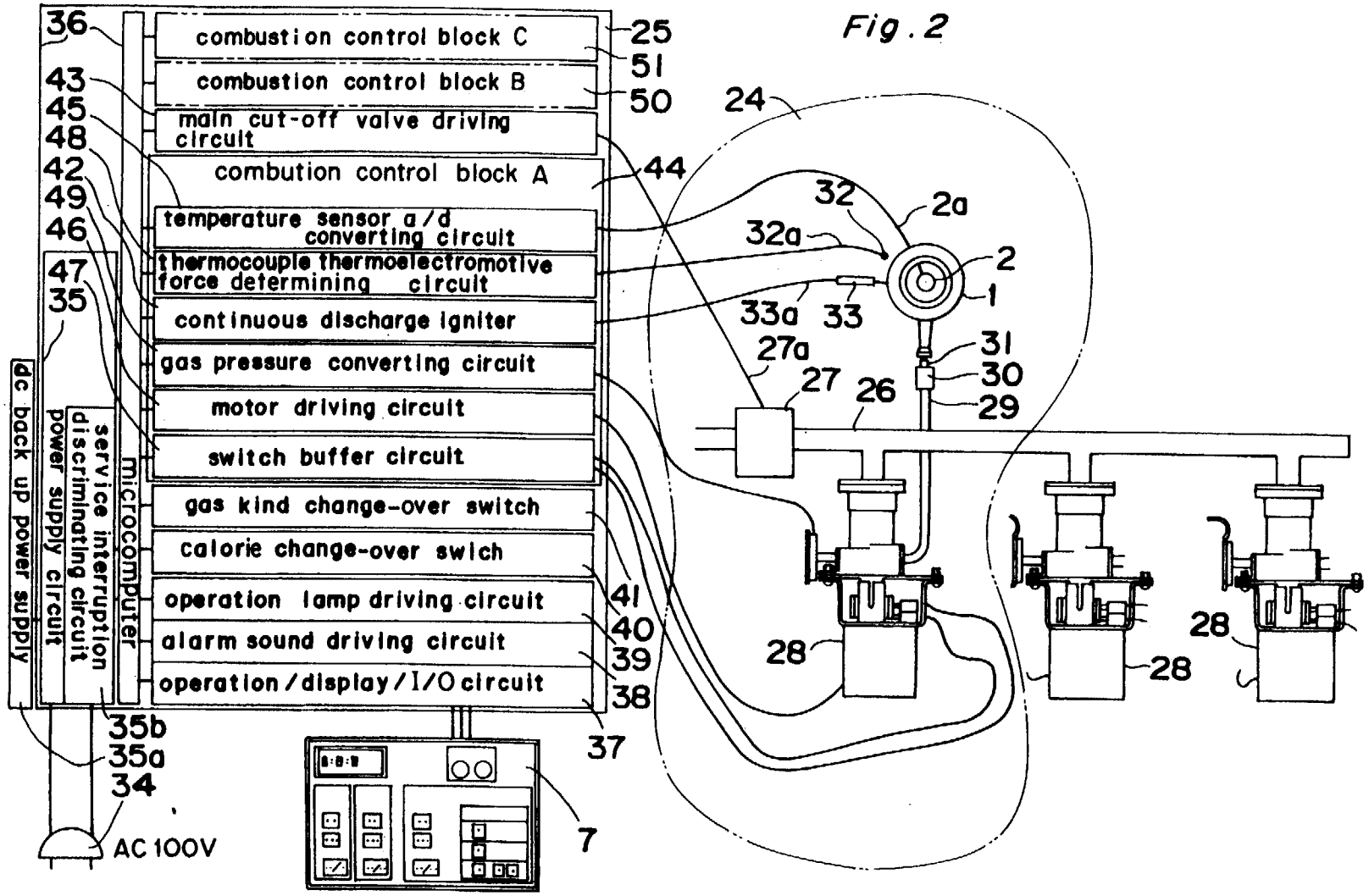
Fig. 2
combustion control block C
combustion control block B
main cut-off valve driving circuit
combution control block A
temperature sensor a/d converting circuit
thermocouple thermoelectromotive force determining circuit
continuous discharge igniter
gas pressure converting circuit
motor driving circuit
switch buffer circuit
gas kind change-over switch
calorie change-over swich
operation lamp driving circuit
alarm sound driving circuit
operation/display/I/O circuit
microcomputer
service interruption discriminating circuit
power supply circuit
dc back up power supply
AC 100V

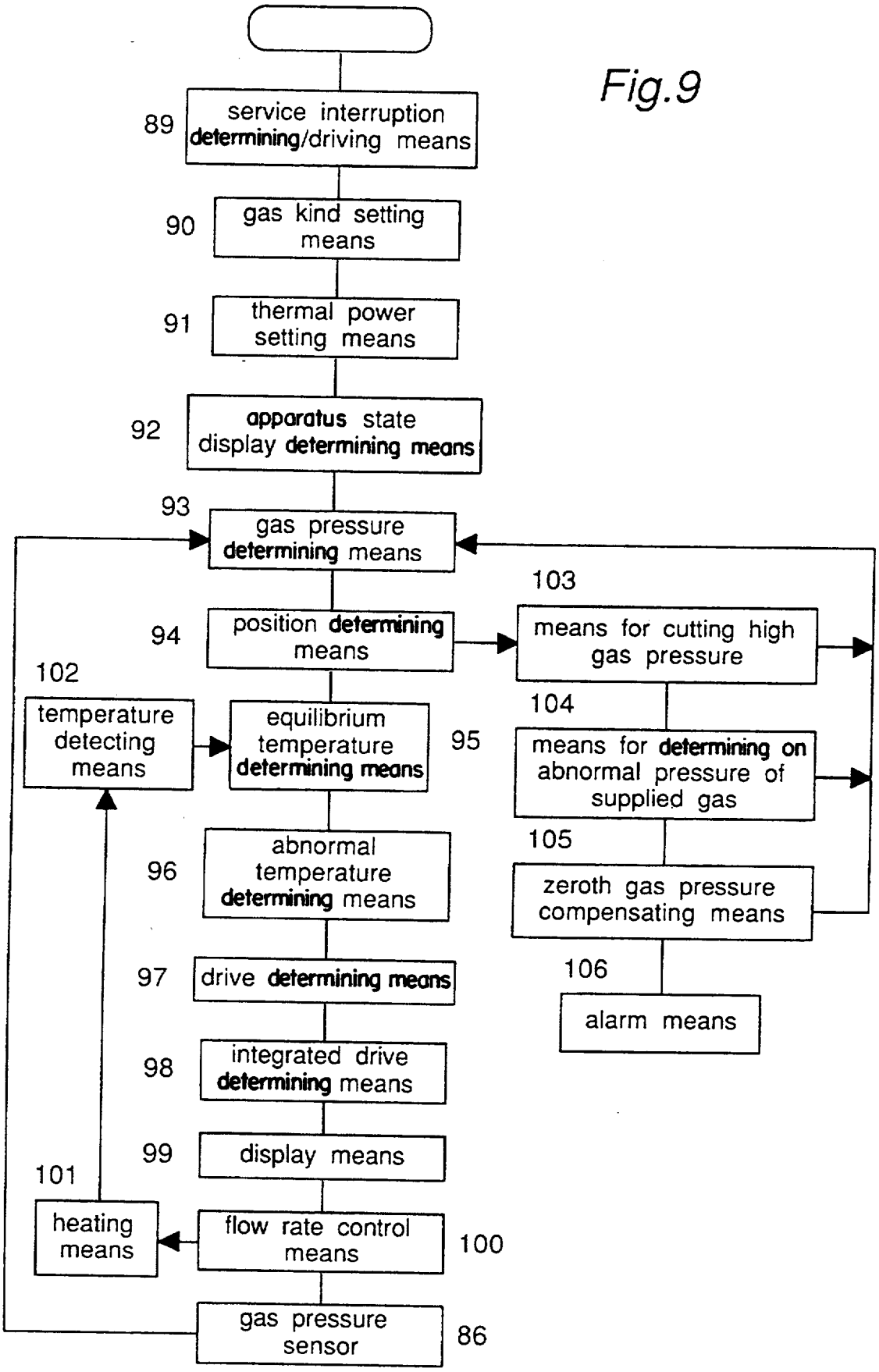
Fig.9
89
service interruption determining/driving means
90
gas kind setting means
91
thermal power setting means
92
apparatus state display determining means
93
gas pressure determining means
94
position determining means
103
means for cutting high gas pressure
102
temperature detecting means
equilibrium temperature determining means
95
104
means for determining on abnormal pressure of supplied gas
96
abnormal temperature determining means
105
zeroth gas pressure compensating means
97
drive determining means
106
alarm means
98
integrated drive determining means
99
display means
101
heating means
flow rate control means
100
gas pressure sensor
86

| Fig.11(a) |
| --- |
| Fig.11(b) |

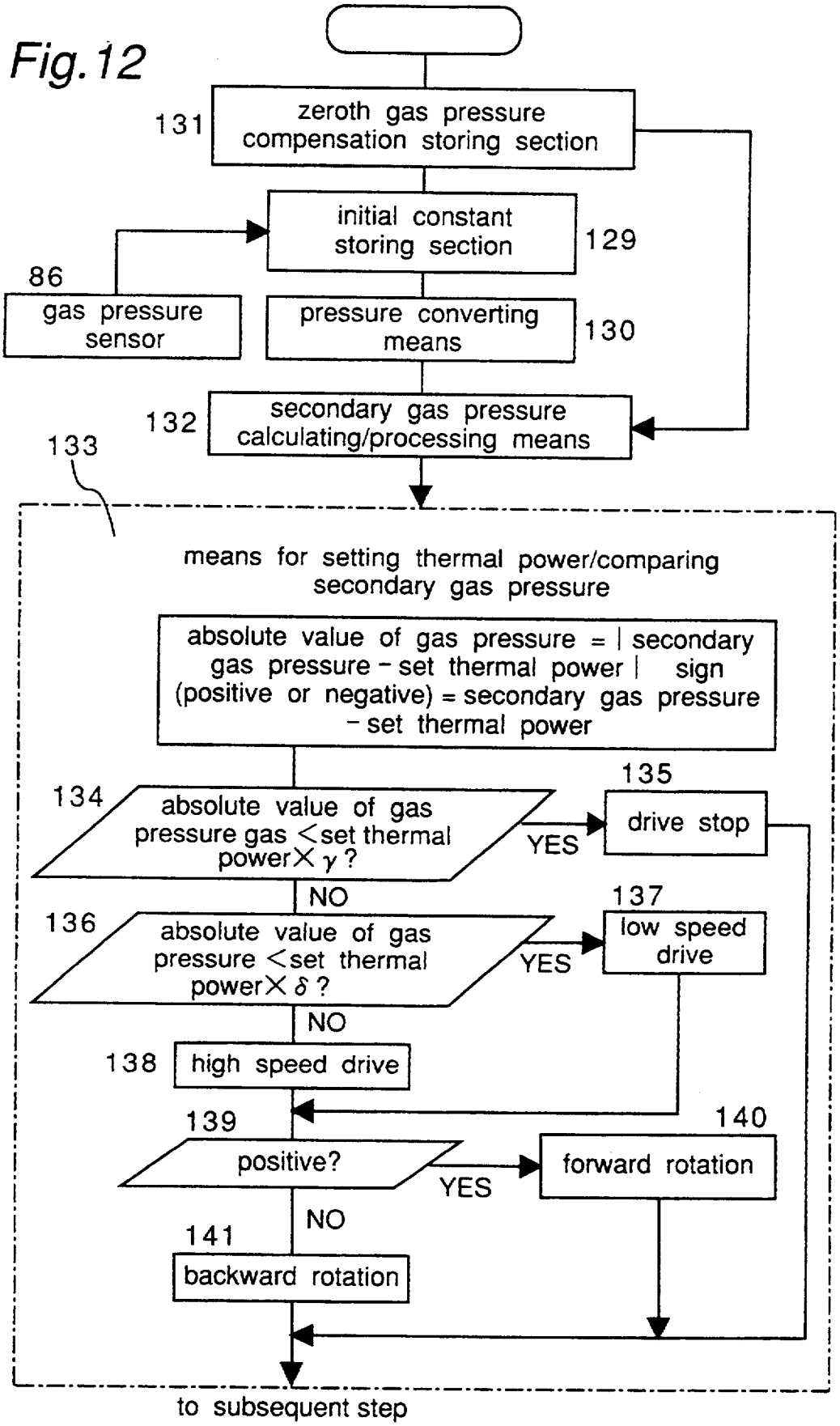
Fig. 12
131
zeroth gas pressure compensation storing section
initial constant storing section
129
86
gas pressure sensor
pressure converting means
130
132
secondary gas pressure calculating/processing means
133
means for setting thermal power/comparing secondary gas pressure
absolute value of gas pressure = | secondary gas pressure − set thermal power | sign (positive or negative) = secondary gas pressure − set thermal power
134
absolute value of gas pressure gas < set thermal power × γ ?
YES
135
drive stop
NO
136
absolute value of gas pressure < set thermal power × δ ?
YES
137
low speed drive
NO
138
high speed drive
139
positive?
YES
140
forward rotation
NO
141
backward rotation
to subsequent step

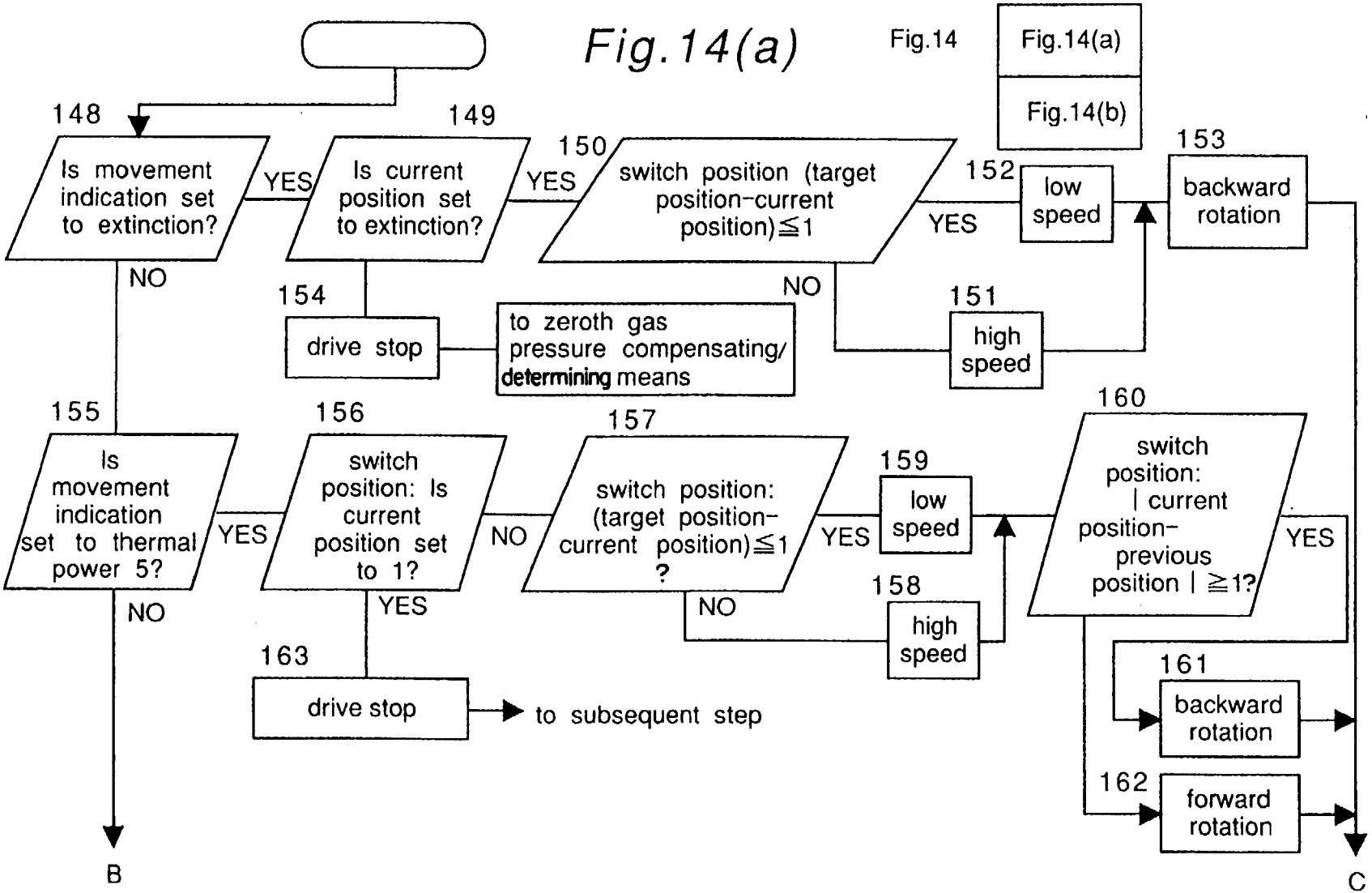
Fig.14(a)
Fig.14(b)
Fig.14
148
Is movement indication set to extinction?
YES
NO
149
Is current position set to extinction?
YES
NO
150
switch position (target position-current position)≦1
YES
NO
151
high speed
152
low speed
153
backward rotation
154
drive stop
155
Is movement indication set to thermal power 5?
YES
NO
156
switch position: Is current position set to 1?
YES
NO
157
switch position: (target position-current position)≦1 ?
YES
NO
158
high speed
159
low speed
160
switch position: | current position- previous position | ≧1?
YES
161
backward rotation
162
forward rotation
163
drive stop
to zeroth gas pressure compensating/determining means
to subsequent step
B
C

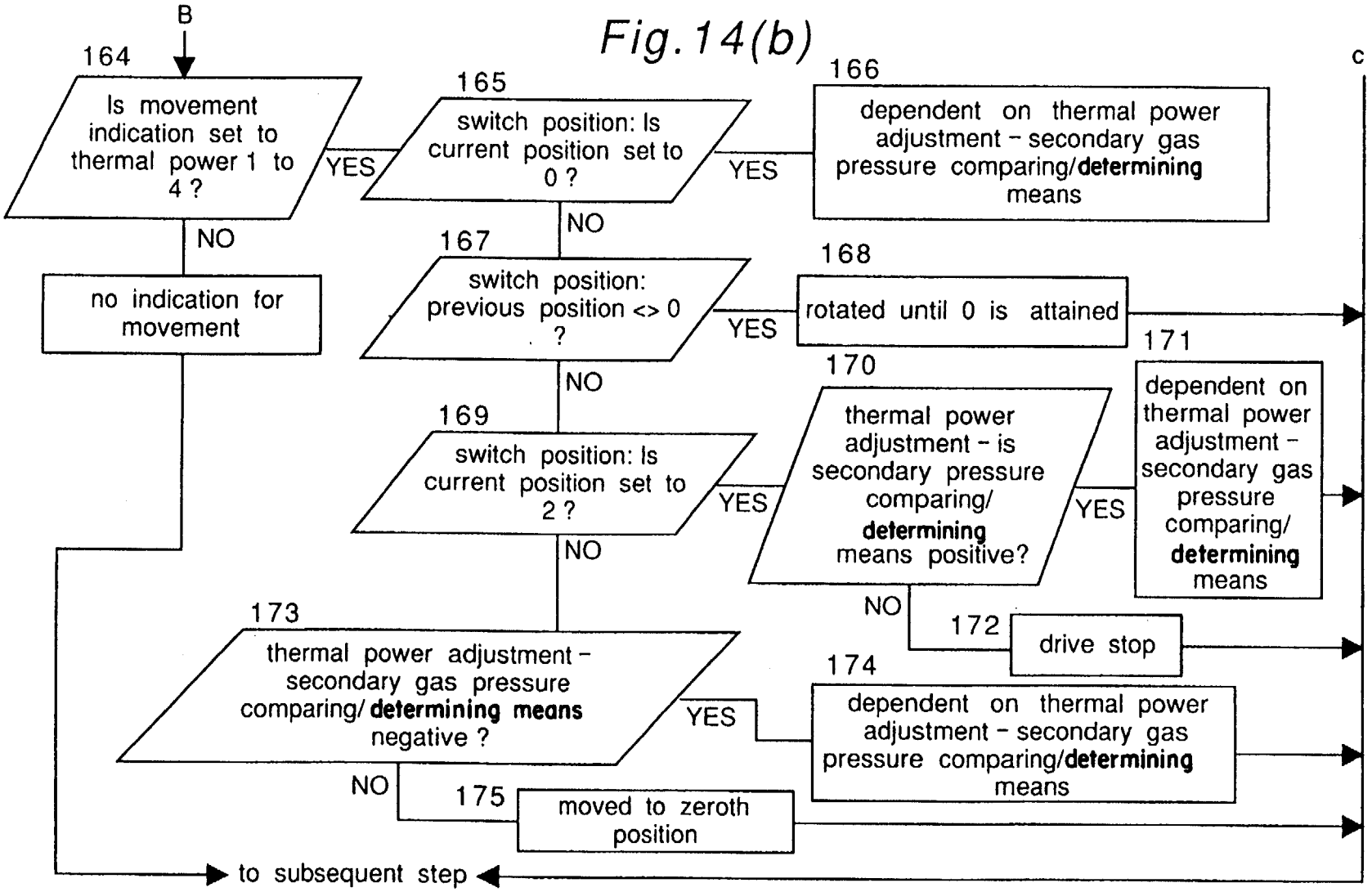
Fig. 14(b)
B
C
164
Is movement indication set to thermal power 1 to 4 ?
YES
NO
no indication for movement
165
switch position: Is current position set to 0 ?
YES
NO
166
dependent on thermal power adjustment - secondary gas pressure comparing/determining means
167
switch position: previous position <> 0 ?
YES
NO
168
rotated until 0 is attained
169
switch position: Is current position set to 2 ?
YES
NO
170
thermal power adjustment - is secondary pressure comparing/ determining means positive?
YES
NO
171
dependent on thermal power adjustment - secondary gas pressure comparing/ determining means
172
drive stop
173
thermal power adjustment - secondary gas pressure comparing/ determining means negative ?
YES
NO
174
dependent on thermal power adjustment - secondary gas pressure comparing/determining means
175
moved to zeroth position
to subsequent step

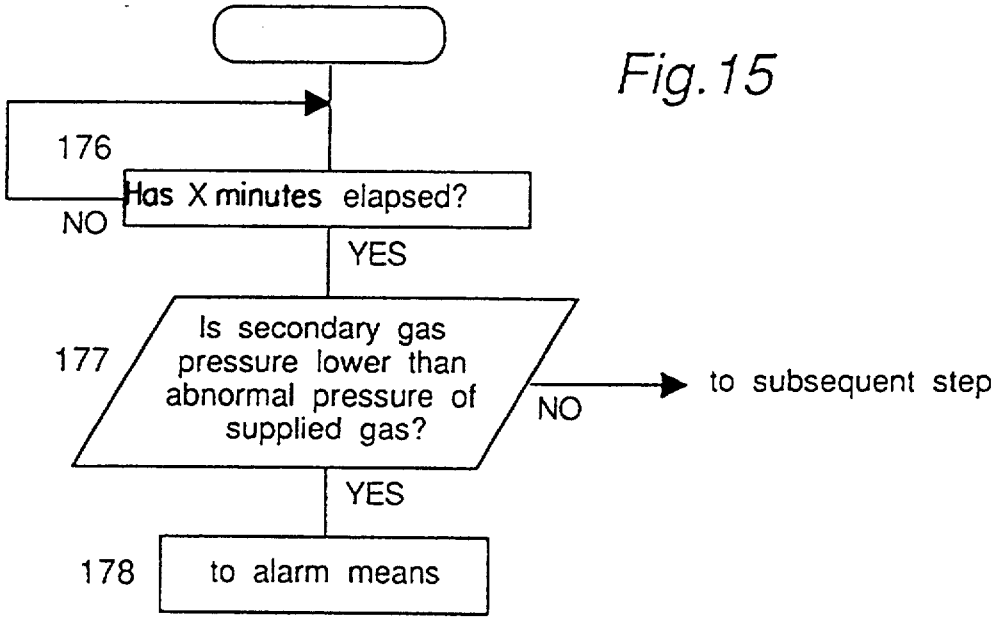
Fig. 15
176
Has X minutes elapsed?
NO
YES
177
Is secondary gas pressure lower than abnormal pressure of supplied gas?
NO
to subsequent step
YES
178
to alarm means

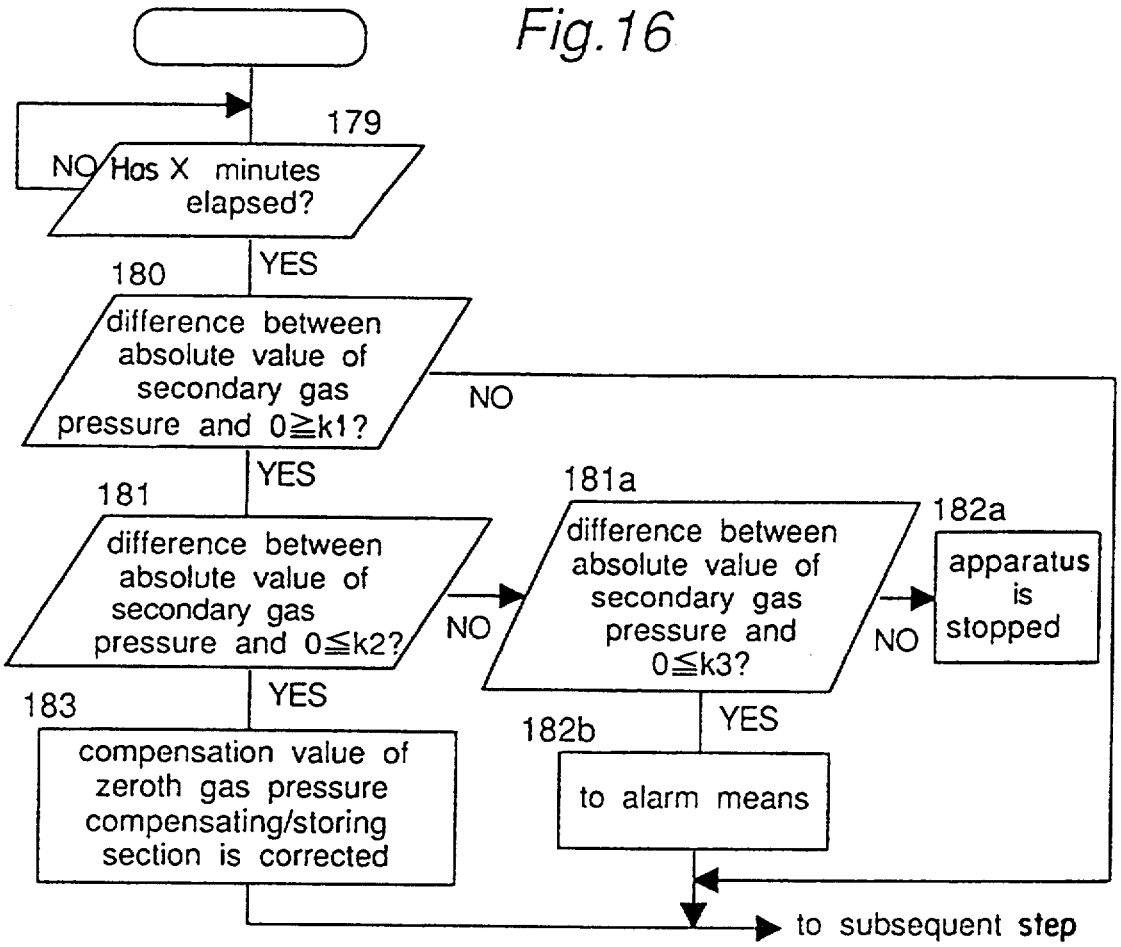
Fig. 16
179
NO
Has X minutes elapsed?
YES
180
difference between absolute value of secondary gas pressure and 0≧k1?
NO
YES
181
difference between absolute value of secondary gas pressure and 0≦k2?
NO
181a
difference between absolute value of secondary gas pressure and 0≦k3?
NO
182a
apparatus is stopped
YES
183
compensation value of zeroth gas pressure compensating/storing section is corrected
182b
YES
to alarm means
to subsequent step

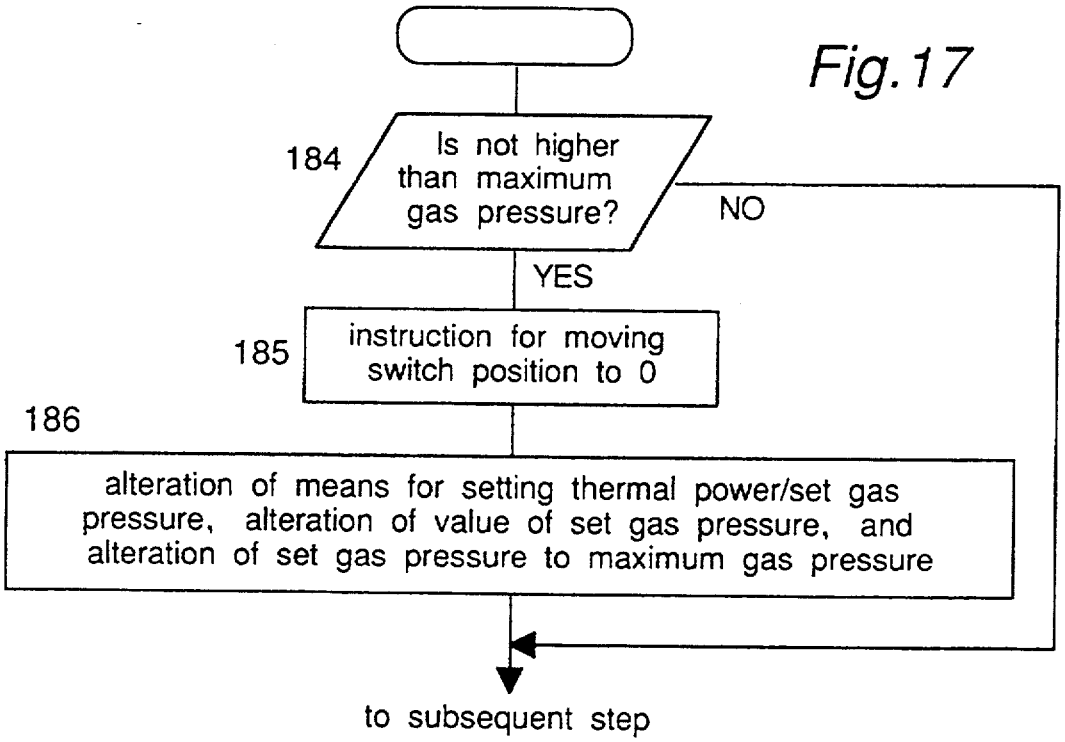
Fig. 17
184
Is not higher than maximum gas pressure?
NO
YES
185
instruction for moving switch position to 0
186
alteration of means for setting thermal power/set gas pressure, alteration of value of set gas pressure, and alteration of set gas pressure to maximum gas pressure
to subsequent step

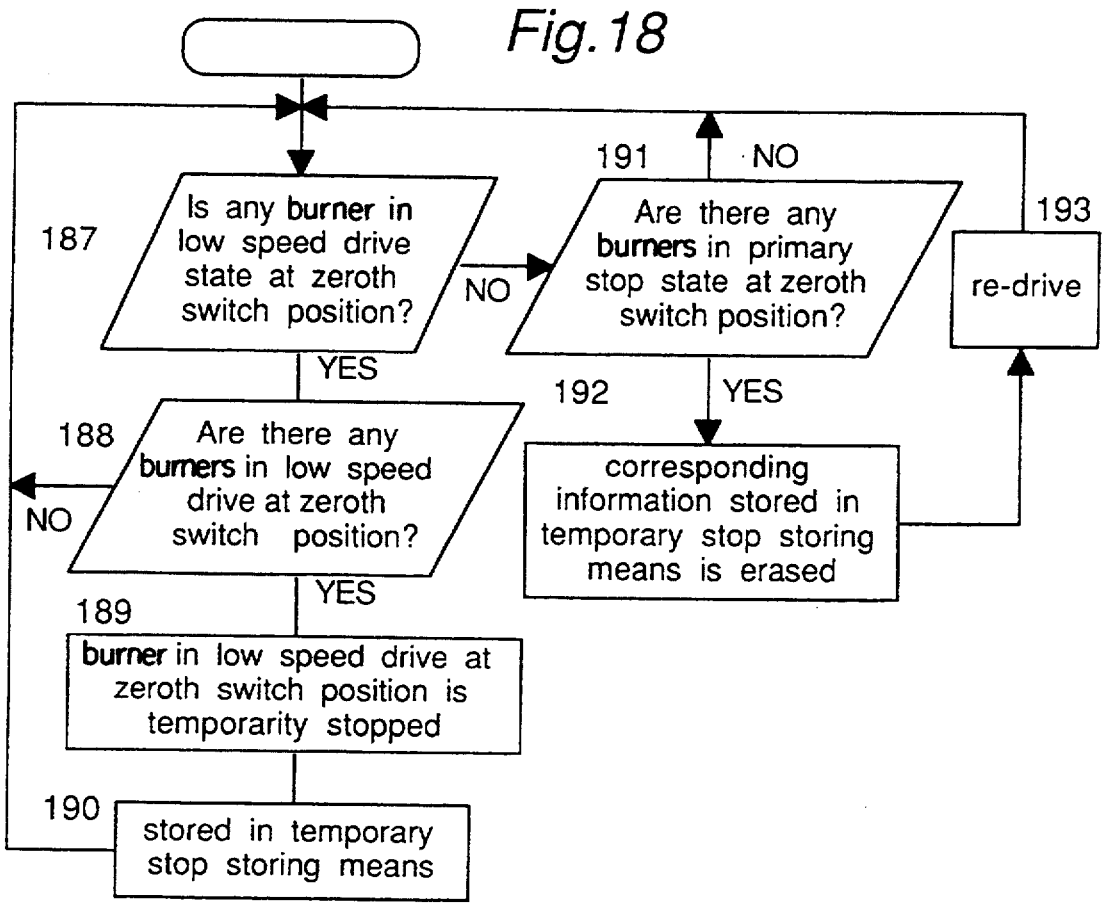
Fig. 18
187
Is any burner in low speed drive state at zeroth switch position?
NO
YES
191
NO
Are there any burners in primary stop state at zeroth switch position?
193
re-drive
192
YES
corresponding information stored in temporary stop storing means is erased
188
Are there any burners in low speed drive at zeroth switch position?
NO
YES
189
burner in low speed drive at zeroth switch position is temporarity stopped
190
stored in temporary stop storing means 201
service interruption determining means
202
service interruption?
NO
YES
203
back-up power supply is driven
204
display of display means is stopped
205
two kinds of thermal powers are set by thermal power setting means
206
back-up power supply is stopped
207
display means and thermal power setting means are restored
to subsequent step

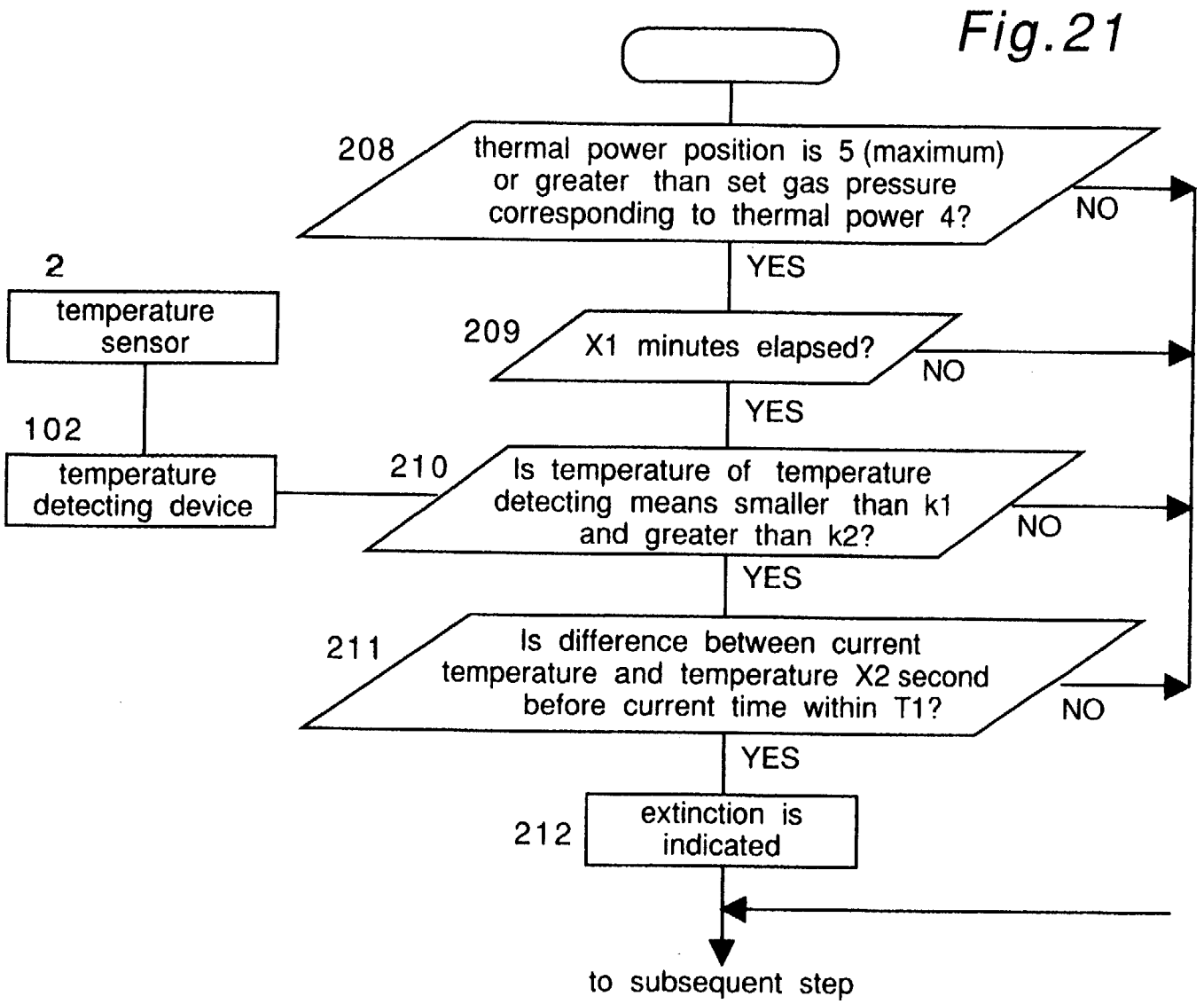
Fig.21
thermal power position is 5 (maximum) or greater than set gas pressure corresponding to thermal power 4?
208
YES
NO
X1 minutes elapsed?
209
YES
NO
Is temperature of temperature detecting means smaller than k1 and greater than k2?
210
YES
NO
Is difference between current temperature and temperature X2 second before current time within T1?
211
YES
NO
extinction is indicated
212
to subsequent step
temperature sensor
2
temperature detecting device
102

GAS BURNING APPARATUS

BACKGROUND OF THE INVENTION

1. Field of the Invention

The present invention relates to a gas burning instrument and more particularly to a gas burning apparatus providing a burning control section suitable for various kinds of gases and a safe burning and preventing a set burning amount from being varied irrespective of the fluctuation in the pressure of supplied gas. To this end, the pressure of gas will be jetted from a nozzle is measured to control it in conformity to a desired burning amount. The present invention also relates to a gas burning apparatus capable of easily deciding the failure of a sensor adapted for detecting the temperature of a pan bottom.

2. Description of the Related Arts

FIGS. 25 through 27 show an example of a conventional gas burning apparatus applied to a gas cooking apparatus. FIG. 25 is a perspective view showing the conventional gas cooking apparatus. FIG. 26 is an enlarged view showing an operation panel. FIG. 27 is a schematic view showing the construction of an oven. As shown in FIG. 25, the gas cooking apparatus comprises a burner 1, a temperature sensor 2, a pan holder 3, an ignition/extinction button 4, a thermal power adjusting lever 5, a grill portion 6, and an operation panel 7. The operation panel 7 as shown in FIG. 26 comprises a display tube 8 for displaying a time/temperature, an LED 9 for displaying various kinds of cooking modes, and a key 10 for setting various kinds of cooking modes. For example, in setting a mode for frying fish, vegetable or the like, an operator presses the key 10 and sets a desired temperature by operating an UP key or a DOWN key 11 while the operator is watching a numerical value displayed by the display tube 8. FIG. 27 is a schematic view showing the construction of the oven. An ignition switch 18 is turned on when the ignition/extinction button 4 is depressed, and electric current is supplied to a main electromagnetic valve 12 and a temperature adjusting valve 14 via a control substrate 19. Gas is fed to the burner 1 via the main electromagnetic valve 12, a hand valve 13, the temperature adjusting valve 14, a bypass key 15, a thermal power adjusting needle 16, and a main nozzle 17, with the maximum flow rate of gas regulated. At the same time, an igniter 20 is turned on via the control substrate 19 and an ignition plug 21 is discharged. Then, the burner 1 starts burning and a thermocouple 22 receives heat from the burner 1 and transmits thermoelectromotive force to the control substrate 19. In this manner, burning continues.

The thermal power adjusting lever 5 is operated to move the thermal power adjusting needle 16 in adjusting thermal power. In this manner, combustion amount is adjusted. Otherwise, the power supply of the temperature adjusting valve 14 is turned on and off in automatically adjusting temperature so as to regulate the combustion amount by the bypass key 15 or by the main nozzle 17.

In changing the kind of gas due to removal or the like, it is necessary to exchange or adjust parts such as the bypass key 15, the thermal power adjusting needle 16, the main nozzle 17, a governor for grill, and a damper 23 for taking in primary air.

The conventional thermal power adjusting method has the following disadvantages: 10 Thermal power is adjusted by the thermal power adjusting needle 16 or switched from a strong degree to a weak degree or vice versa by an electromagnetic valve. The burning amount is not measured or controlled. When the pressure of supplied gas fluctuates, it is impossible to adjust the burning amount to a constant value. Accordingly, the allowable range of the pressure of the supplied gas is wide. For example, in the case of 13A gas, minimum gas pressure is 100 mm $H_2O$; central gas pressure is 200 mm $H_2O$; and maximum gas pressure is 250 mm $H_2O$. Even though thermal power is reduced to 100 mm $H_2O$, it is necessary for the thermocouple to secure an appropriate thermoelectromotive force to prevent an accidental fire. As a result, the gas burning apparatus is incapable of reducing thermal power to 40% of safety factor. A rapid change occurs in the strength of flame because gas is burnt strongly and weakly by a temperature adjusting valve in adjusting temperature automatically, which gives a user discomfort. In addition, in controlling thermal power by a strong thermal power or a weak thermal power or by the burning period of time, the operation sounds of valves are frequently generated, which is offensive to the ear.

If a pressure sensor fails and as a result, gas leakage occurs because means for preventing the gas cooking apparatus from being fired has not been devised.

Thermal power cannot be reduced to a small thermal power if foreign matter has stuck to a gap of the mechanism of the flow rate control means.

A function of detecting an abnormal pressure of supplied gas is not provided. The abnormal pressure is generated because gas is not supplied sufficiently if an LPG bomb is vacant, a rubber pipe is bent or a cock is half-opened. Therefore, for example, when two ovens are used, the thermal power is weak or gas is ignited but extinguishes soon. A user cannot find the reason easily and hence, telephone calls for repair.

In adjusting gas pressure while it is being detected by a gas pressure sensor, it is necessary that thermal power adjusting period of time is set to be short to prevent boil-over by performing a rough pressure adjustment and a fine pressure adjustment in consideration of the correlation between the pressure-adjusting accuracy of a reducing mechanism, the performance thereof, and the capability of detecting gas pressure.

The pressures of supplied gases are different from each other in conventional gas burning apparatuses. Depending on the kind of gas, the maximum pressure is higher by 40% than the standard pressure. As a result, the temperature of the gas cooking apparatus greatly increases or an abnormal burning occurs due to an abnormal gas pressure.

A conventional two-oven burning apparatus has a small burner having a combustion amount of approximately 2000 Kcal/h and a large burner having a combustion amount of approximately 4000 Kcal/h. The minimum combustion amount of each burner is approximately 400 Kcal/h and 500 Kcal/h, respectively. When the burning amount of gas is reduced further, flame is not formed and extinguishes. Therefore, large and small needles for adjusting thermal power are used for each burner. Consequently, in changing the kind of gas, parts exchanges are required by disassembling a gas cock. In this case, a gas leakage or an erroneous parts exchange may occur.

The minimum combustion amount is not constant because burning speeds and caloric values are different from each other, respectively depending on the kind of gas. Accordingly, it is necessary to provide a needle for setting a minimum burning amount for each kind of gas burner. Thus, a large number of parts and assembling parts are required to use a different kind of gas. Hence, it is necessary to disassemble a gas mechanical block in using a different kind of gas, which requires a skilled work and much time. Accordingly, cost for using a different kind of gas is high.

In using the apparatus as an industrial measuring instrument to measure combustion amount by the pressure sensor, which has not been conventionally adopted, a zero point adjustment can be accomplished in the beginning of use. But in the case of a gas oven, it is difficult for old people or children to perform a zero point adjustment and in addition, an incomplete combustion occurs.

It occurs that the function of the pressure sensor deteriorates with the elapse of time and hence the apparatus cannot be used, which gives a user inconvenience.

If the performance of the apparatus deteriorates with the elapse of time, thermal power cannot be adjusted and a user has an inconvenience in using it.

It is preferable to install a safety device on each burner to cut off gas in consideration of the situation in which one of burning apparatuses provided under each burner fails. But electric power is required in proportion to the number of burners and the manufacturing cost is high.

When the thermal powers of a plurality of burners are simultaneously adjusted by using the pressure sensor, the thermal powers thereof cannot be simultaneously adjusted due to the relationship between the processing speed of the microcomputer and the flow rate control means. It takes much time to adjust thermal power individually. For example, if thermal power is required to be reduced with food contained in a pan placed on one oven being boiled, water in the pan boils over.

In checking the performance of the pressure sensor provided in a gas burning apparatus, a specific checking tool is required in manufacturing the gas burning apparatus. It takes time and labor to install the checking tool on the apparatus and remove it therefrom. A service man does not carry it with him. Therefore, there is problem with the use of the checking tool.

Since conventional gas burning apparatuses do not comprise the pressure sensor, a needle corresponding to each kind of gas is conventionally used. The gas burning apparatus according to the present invention is provided with a universal flow rate control means capable of adjusting city gas ranging from a low Wobbe index to liquified petroleum gas (LPG).

The area through which gas flows is slight in the construction of the universal flow rate control means adapted for the minimum flow rate adjustment of LPG having the highest calorific value. Therefore, the conventional reducing mechanism does not ensure a reliable control of the flow rate of gas.

If dust sticks to the adjusting mechanism of the universal flow rate control means, a countermeasure for preventing the adjusting mechanism from being destroyed is required in consideration of thermal power cannot be reduced to a predetermined value.

The above-described conventional gas oven is more expensive than other conventional gas ovens because of construction. Therefore, it is necessary to take a measure of using some functions of other gas ovens in common.

It is also necessary to take a measure so that the cut-off means gives rise to a gas leakage due to the common use of some functions of both type.

It is necessary to adjust thermal power at a high speed so that the universal flow rate control means can be easily used and does not give inconvenience to a user.

Few conventional gas burning apparatuses need power supply and therefore, can be used during service interruption. Unless the above-described conventional gas burning apparatus can be used in during service interruption, it does not sell well.

It occurs that a conventional detecting means is incapable of detecting the defect of the temperature sensor depending on the content of defect.

SUMMARY OF THE INVENTION

It is an object of the present invention to provide a gas burning apparatus having a burning control section suitable for various kinds of gases for safe burning.

It is another object of the present invention to provide a gas burning apparatus preventing a set burning amount from being varied irrespective of the fluctuation in the pressure of supplied gas.

It is still another object of the present invention to provide a gas burning apparatus capable of easily deciding the failure of a sensor adapted for detecting the temperature of a pan bottom.

In accomplishing these and other objects, as a first means, a gas burning apparatus comprises: burner means for burning combustible gas; a nozzle for supplying combustible gas to the burner means; flow rate control means for controlling the amount of the combustible gas to be supplied to the nozzle; gas pressure detecting means for detecting the pressure of the combustible gas supplied between the flow rate control means and the nozzle; thermal power setting means for setting the combustion amount of the combustible gas in the burner means; central control means, connected with the thermal power setting means and the gas pressure detecting means, for adjusting the amount of the combustible gas to be supplied to the burner means to a predetermined value by driving the flow rate control means in response to a signal outputted from the gas pressure detecting means, so that the combustion amount in the burner means corresponds to a burning state set by the thermal power setting means.

As a second means, in the gas burning apparatus, gas is introduced into a pressure sensing portion of the gas pressure detecting means via a duct disposed between the flow rate control means and the nozzle and via a flow rate restricting portion.

As a third means, in the gas burning apparatus, the flow rate control means comprises: reducing means for varying the flow rate of the combustible gas to be supplied to the nozzle; and driving means for driving the reducing means, so that when a gas pressure detected by the gas pressure detecting means in a state in which the reducing means is closed to the greatest extent does not reach a predetermined position corresponding to a value set by the thermal power setting means, the central control means stops the opening and closing operation of the reducing means to be performed by the driving means at a predetermined closing limit position.

As a fourth means, the gas burning apparatus further comprises: gas kind change-over means for changing the kind of gas to be used; and position detecting means for detecting a reducing position in a region in which the value of the reducing means of the flow rate control means becomes maximum. When the pressure of gas detected by the gas pressure detecting means is lower than the predetermined gas pressure, the central control means gives an alarm and/or stops the supply of combustible gas to the burner means.

As a fifth means, in the Was burning apparatus, the central control means comprises: drive speed deciding means for controlling the drive speed of the driving means so that the drive speed deciding means controls the drive speed of the driving means according to the degree of the difference between the pressure of gas corresponding to a predetermined thermal power set by the thermal power setting means and the pressure of Was detected by the gas pressure detecting means.

As a sixth means, the gas burning apparatus further comprises: the gas kind change-over means. When the pressure of gas detected by the gas pressure detecting means is higher than a maximum gas pressure of a certain kind of gas set by the gas kind change-over means in setting a maximum thermal power by the thermal power setting means, the central control means drives the flow rate control means so as to adjust the pressure of gas detected by the gas pressure detecting means to the maximum gas pressure set by the gas kind change-over means.

As a seventh means, the gas burning apparatus further comprises: burner calory change-over means for setting a maximum combustion amount corresponding to the combustion performance of each burner so that the central control means corrects the value of gas pressure equivalent to a minimum combustion amount corresponding to the maximum combustion amount of each burner set by the burner calory change-over means.

As an eighth means, the gas burning apparatus further comprises: the gas kind change-over means for changing the kind of gas. The central control means decides the kind of gas set by the kind change-over means, and a minimum gas pressure equivalent to a minimum thermal power of the thermal power setting means is set in advance in the central control means depending on the kind of gas.

As ninth means, in the gas burning apparatus, the flow rate control means comprises: closing means for opening and closing a gas path, and the central control means comprises: storing means for storing the pressure (atmospheric pressure) of gas applied to the gas pressure detecting means if the pressure of gas is within a predetermined value provided that the closing means is in a closed state; and gas pressure deciding/compensating means for altering and correcting a reference value by regarding that the pressure of gas stored in the storing means is the atmospheric pressure.

As a ninth means, in the gas burning apparatus, the flow rate control means comprises: closing means for opening and closing the gas path, and the central control means comprises: storing means for storing the pressure (atmospheric pressure) of gas to be applied to the gas pressure detecting means if the pressure of gas is within a predetermined value provided that the closing means is in a closed state so that an alarm is sounded when the pressure (atmospheric pressure) of gas applied to the gas pressure detecting means exceeds a predetermined value provided that the closing means is in a closed state.

As a tenth means, in the gas burning apparatus, the flow rate control means comprises: closing means for opening and closing a gas path, and the central control means comprises: storing means for storing the pressure (atmospheric pressure) of gas applied to the gas pressure detecting means if the pressure of gas is within a predetermined value provided that the closing means is in a closed state so that combustion is stopped when the pressure (atmospheric pressure) of gas applied to the gas pressure detecting means exceeds a predetermined value provided that the closing means is in a closed state.

As a twelfth means, in the gas burning apparatus comprising a plurality of burning apparatuses, gas is supplied from one gas cut-off valve to each burning apparatus.

As a thirteenth means, in the gas burning apparatus the flow rate control means comprises: reducing means for varying the flow rate of the combustible gas to be supplied to the nozzle; driving means for driving the reducing means; position detecting means for detecting the limit of the movable range of the reducing means and a current position within the movable range; and closing means for opening and closing the gas path. The driving means serves as means for driving the reducing means and the closing means; and the driving means and a closing portion of the closing means are spaced from each other when the closing means is closed.

As a thirteenth means, in the gas burning apparatus comprising a plurality of burning apparatuses, the flow rate control means of each burning apparatus comprises: reducing means for varying the flow rate of the combustible gas to be supplied to the nozzle; driving means for driving the reducing means; for detecting the limit of the movable range of the reducing means and a current position within the movable range; closing means for opening and closing the gas path. The central control means comprises: the drive speed deciding means for controlling the drive speed of the driving means of the flow rate control means; and integrated drive deciding means for performing an integrated control over the drive of each of a plurality of the independent flow rate control means. The integrated drive deciding means is operated in a predetermined priority order when the difference between the pressure of gas corresponding to a thermal power set by the thermal power setting means and the pressure of gas supplied by the gas pressure detecting means is detected to be smaller than a predetermined value in the burning operations of a plurality of burning apparatuses.

As a fifteenth means, the gas burning apparatus further comprises: display means for displaying the set state of combustion; and state display deciding means, provided on the central control means, for deciding on the performance of the gas burning apparatus by operating a specific key so that the state display deciding means allows the gas pressure detected by the gas pressure detecting means to be displayed by the display means.

As a sixteenth means, in the gas burning apparatus, the reducing mechanism of reducing means for performing thermal power adjustment controls the flow rate of gas of a low calorific value and a high calorific value by means of a single driving means.

As a seventeenth means, in the gas burning apparatus, an opening for adjusting the flow rate of LPG to minimum is provided independently of the reducing mechanism.

As an eighteenth means, the gas burning apparatus further comprises: driving means for driving the reducing means; and position detecting means for detecting the limit of the movable range of the reducing means and a current position within the movable range. The reducing means is provided with a shock absorbing device at a limit point of the movable range in a direction in which the flow rate of gas is reduced to a minimum.

As a nineteenth means, the gas burning apparatus further comprises: position detecting means for detecting the limit of the movable range of the reducing means and a current position within the movable range; and closing means for opening and closing a gas path. The driving means serves as means for driving the reducing means and the closing means.

As a twentieth means, a gas burning apparatus comprises: burner means for burning combustible gas; a nozzle for supplying combustible gas to the burner means; flow rate control means, for controlling the amount of the combustible gas to be supplied to the nozzle, comprising: reducing means, for varying the flow rate of combustible gas to be supplied to the nozzle; driving means for driving the reducing means; and position detecting means for detecting the limit of the movable range of the reducing means and a current position within the movable range; and thermal power setting means for setting the combustion amount of the combustible gas in the burner means: central control means for driving the flow rate control means by a signal outputted from the position detecting means so as to move the flow rate control means to a reducing position of the reducing means corresponding to a thermal power set by the thermal power setting means. The central control means comprises: drive speed deciding means for controlling the drive speed of the driving means according to the distance between a current position in the movable range of the reducing means and a position of the reducing means driven by the driving means from the current position when the thermal power setting means alters thermal power.

A 21st means, a gas burning apparatus comprises: thermal power setting means for setting the thermal power; flow rate control means for adjusting thermal power; state display deciding means for deciding on the performance of the gas burning apparatus; display means for displaying various states including the temperature of a temperature sensor and cooking period of time; a back-up power supply for supplying power supply in service interruption; and service interruption deciding means for limiting or stopping the display of the display means so as to save electric power in service interruption.

As a 22nd means, a gas burning apparatus comprises: temperature detecting means for detecting the temperature of a pan bottom; burner means for burning combustible gas; a nozzle for supplying combustible gas to the burner means; rate control means, for controlling the amount of the combustible gas to be supplied to the nozzle, comprising: reducing means for varying the flow rate of the combustible gas to be supplied to the nozzle; and driving means for driving the reducing means and position detecting means for detecting the limit of the movable range of the reducing means and a current position within the movable range; thermal power setting means for setting the combustion amount of the combustible gas in the burner means; central control means for driving the flow rate control means to a predetermined position in response to a signal outputted from the position detecting means so that the flow rate control means moves to a reducing position of the reducing means corresponding to a thermal power set by the thermal power setting means. The central control means comprises: equilibrium temperature deciding means for deciding based on a temperature supplied by the temperature detecting means whether or not a temperature rise gradient is greater than a specified value within a predetermined temperature range and whether or not an equilibrium temperature state has been generated so as to decide that the temperature detecting means has become defective and stop the operation of the gas burning apparatus when the equilibrium temperature deciding means has decided that the equilibrium temperature state has been generated and that the position detecting means has decided that the flow rate control means is at a maximum thermal power position.

As a 23rd means, a gas burning apparatus comprises: temperature detecting means for detecting the temperature of a pan bottom; burner means for burning combustible gas; a nozzle for supplying combustible gas to the burner means; flow rate control means for controlling the amount of the combustible gas to be supplied to the nozzle; gas pressure detecting means for detecting the pressure of the combustible gas supplied between the flow rate control means and the nozzle; thermal power setting means for setting the combustion amount of the combustible gas in the burner means; central control means, connected with the thermal power setting means and the gas pressure detecting means, for adjusting the amount of the combustible gas to be supplied to the burner means to a predetermined pressure by driving the flow rate control means in response to a signal outputted from the gas pressure detecting means, so that the combustion amount in the burner means corresponds to a burning state set by the thermal power setting means. The central control means comprises: equilibrium temperature deciding means for deciding based on a temperature supplied by the temperature detecting means whether or not a temperature rise gradient is greater than a specified value within a predetermined temperature range and an equilibrium temperature state has been generated so as to decide that the temperature detecting means has become defective and stop the operation of the gas burning apparatus when the equilibrium temperature deciding means has decided that the equilibrium temperature state has been generated and that the secondary gas pressure is greater than a predetermined gas pressure.

According to the above-described construction, the following operations are obtained.

The gas pressure deciding means detects pressure and the flow rate control means adjusts pressure so that a gas pressure set by the thermal power setting means is attained.

The flow rate restricting device provided on the gas inflow portion of the pressure detecting section restricts the leakage amount of gas when the pressure detecting section is damaged. In addition, if gas leaks even in a slight amount, the leakage amount is indicated as an abnormal gas pressure.

Even though a set gas pressure is not attained, the driving means is stopped at the limit point of the movable range of the position deciding means.

When the secondary gas pressure is less than the predetermined pressure at the maximum thermal power position of the thermal power adjusting device, an alarm is given or burning is stopped.

The drive speed of the flow rate control means is varied by the drive speed deciding means. Therefore, when a strong thermal power is changed to a weak thermal power, the flow rate control means is driven fast until thermal power becomes weak. When the gas pressure is finely adjusted to the set gas pressure, the flow rate control means is driven slowly.

When thermal power is set to the maximum, gas pressure is adjusted to the maximum determined by the limit gas pressure determining means for determining the maximum gas pressure.

Owing to the burner calory setting means and the weak (low) calory compensating means, the burning amount of a burner can be changed. For example, in changing the position of a burner of a large calory and that of a burner of an intermediate calory to each other, a set pressure can be altered in conformity to the capability of each burner without changing the construction of the reducing mechanism. 8. The gas kind setting means sets an optimum minimum gas pressure for each kind of gas in conformity to its own combustibleness. Therefore, an optimum minimum gas pressure can be finely set for each kind of gas.

Owing to the gas pressure deciding/compensating means, an error in measurement due to the atmospheric temperature and aged deterioration can be corrected, and a reference point, obtained when gas has no pressure, can be always corrected.

Owing to the gas pressure deciding/compensating means, an error in measurement which occurs due to the atmospheric temperature or aged deterioration is alarmed.

The gas pressure deciding/compensating means is provided. Therefore, if the gas sensing section often makes erroneous measurements it is incapable of detecting an atmospheric temperature due to a measurement error or aged deterioration, gas is not burnt for safety.

Since only one gas cut-off function is provided for a plurality of burning apparatuses, electric power is consumed by the cut-off valve in a small amount.

The driving means serves as the driving means of the gas cut-off means. When the cut-off means cuts off gas, the driving means and the cut-off means are spaced from each other.

If the difference between a gas pressure set by the thermal power setting means and the secondary gas pressure is less than a certain value in a plurality of burning portions, the pressure difference at each burning portion is adjusted one by one with the operations of remaining burning portions temporarily stopped.

Owing to the state display/deciding means, the secondary gas pressure is displayed on the display means by pressing an appropriate key.

The movable pressure adjusting range of the reducing mechanism can be secured for each kind of gas, for example, gas of a low calorific value and gas of a high calorific value.

The opening for adjusting the flow rate of LPG to the minimum is provided independently of the reducing mechanism of the flow rate control means. Therefore, even though the reducing mechanism is reduced to the maximum, the minimum flow rate is secured.

In the flow rate control means, a shock absorbing device is provided on the reducing mechanism at the limit point of the movable range of the flow rate control means in the minimum reducing direction thereof. In this manner, when thermal power is reduced to the minimum, a shock is applied to the reducing mechanism and the driving device in a reduced degree.

The driving means serves as the driving means of the gas cut-off means. The driving means drives the reducing mechanism and the cut-off means.

The drive speed of the flow rate control means is varied by the drive speed deciding means. Therefore, when a strong thermal power is switched to a small thermal power, the drive speed of the flow rate control means is set to be fast until thermal power becomes small. When a fine adjustment is made to move the flow rate control means to the set position, the drive speed thereof is set to be slow.

The service interruption deciding means limits a display to be made by the display means or stops the display so as to consume a small amount of electric power.

The position deciding means and the equilibrium temperature deciding means discriminate the defective resistance change of the sensor for detecting the temperature of a pan bottom. That is, these means detect an error made by the sensor. Thus, burning is stopped.

BRIEF DESCRIPTION OF THE DRAWINGS

These and other objects and features of the present invention will become clear from the following description taken in conjunction with the preferred embodiments thereof with reference to the accompanying drawings, in which:

FIG. 2 is a block diagram showing the construction of the cooking apparatus and that of an electronic circuit;

FIG. 9 is a block diagram showing the outline of various deciding means of a gas burning apparatus;

FIG. 11(*a*) is the upper portion of the operational diagram for the thermal power setting means with connection to FIG. 11(*b*) at "A";

FIG. 11(*b*) is the lower portion of the operation diagram for the thermal power setting means with connection to FIG. 11(*a*) at "A";

FIG. 12 is a view showing the content of gas pressure deciding means;

FIG. 14 is a key to the reconstruction of FIGS. 14(*a*) and 14(*b*);

FIG. 14(*a*) is the upper portion of the operational diagram for the drive deciding means with connection to FIG. 14(*b*) at "B" and "C";

FIG. 14(*b*) is the lower portion of the operational diagram for the drive deciding means with connection to FIG. 14(*a*) at "B" and "C";

FIG. 15 is a view showing the content of means for deciding on the abnormality of the pressure of supplied gas;

FIG. 16 is a view showing the content of means pressure sensor-zeroth gas pressure compensating/deciding means;

FIG. 17 is a view showing the content of gas pressure means for cutting off a high gas pressure;

FIG. 18 is a view showing the content of integrated drive deciding means;

FIG. 21 is a view showing the content of equilibrium temperature deciding means;

DETAILED DESCRIPTION OF THE INVENTION

Figure 1:
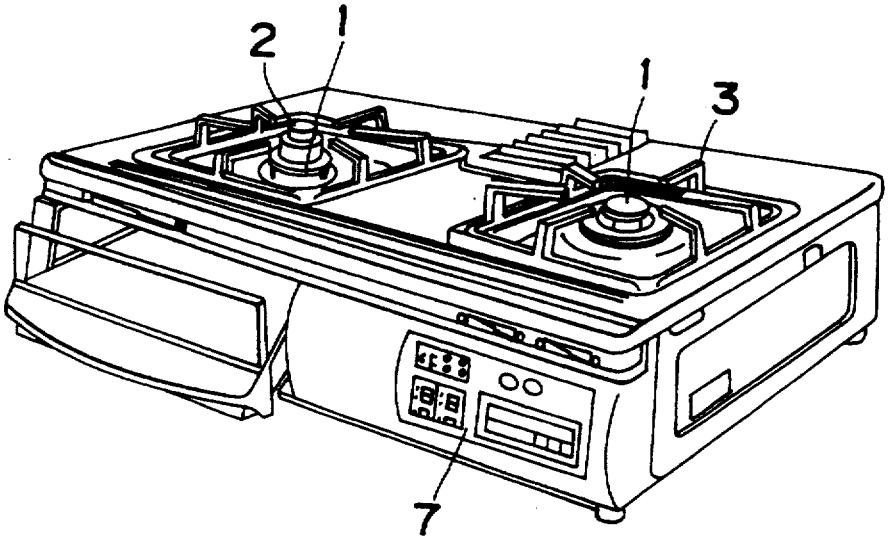
FIG. 1 is a perspective view showing a cooking apparatus according to an embodiment of the present invention.

Before the description of the present invention proceeds, it is to be noted that like parts are designated by like reference numerals throughout the accompanying drawings.

Figure 3:
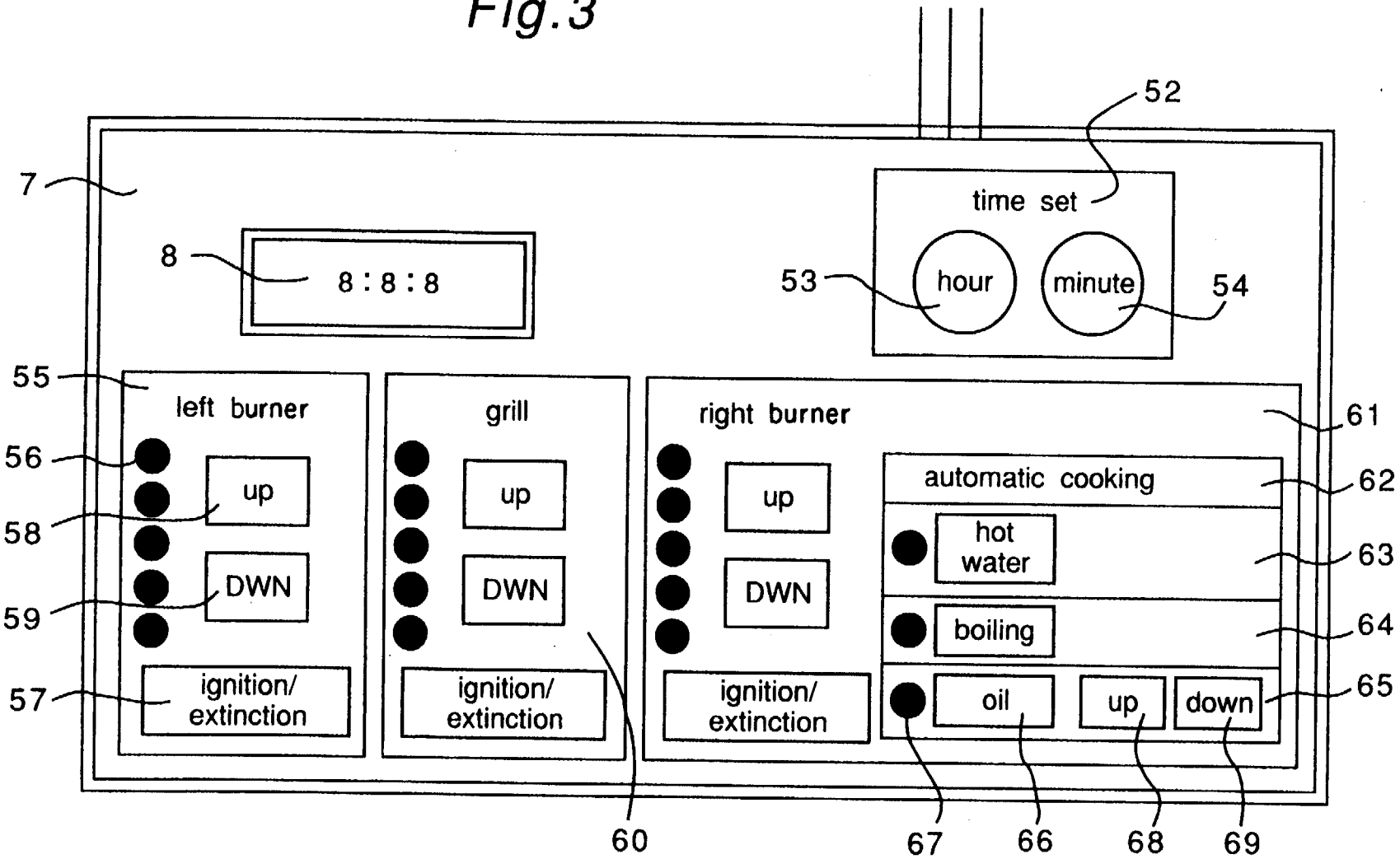
FIG. 3 is an enlarged view showing an operation panel.
Figure 4:
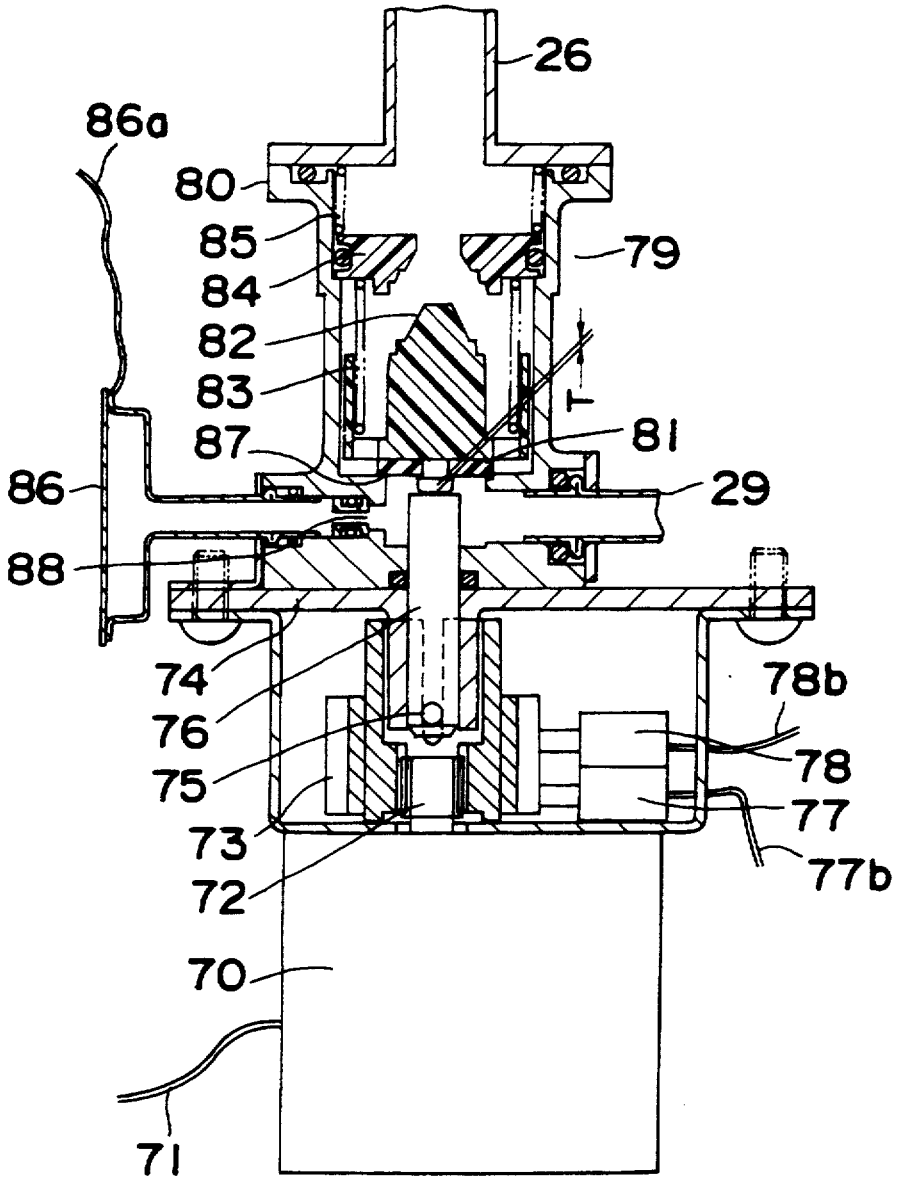
FIG. 4 is an enlarged sectional view showing a flow rate control means in the state in which gas is cut off.
Figure 5:
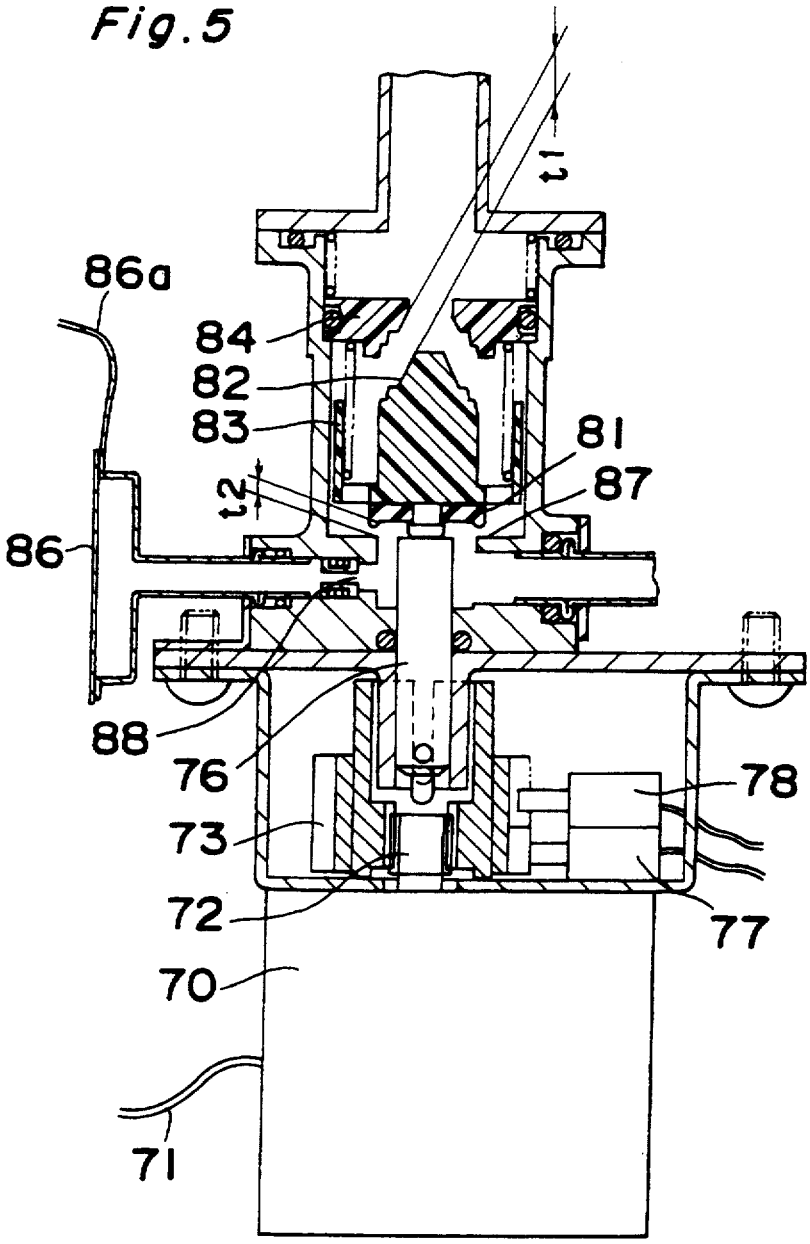
FIG. 5 is an enlarged sectional view showing the flow rate control means in the state in which thermal power is maximum.
Figure 6:
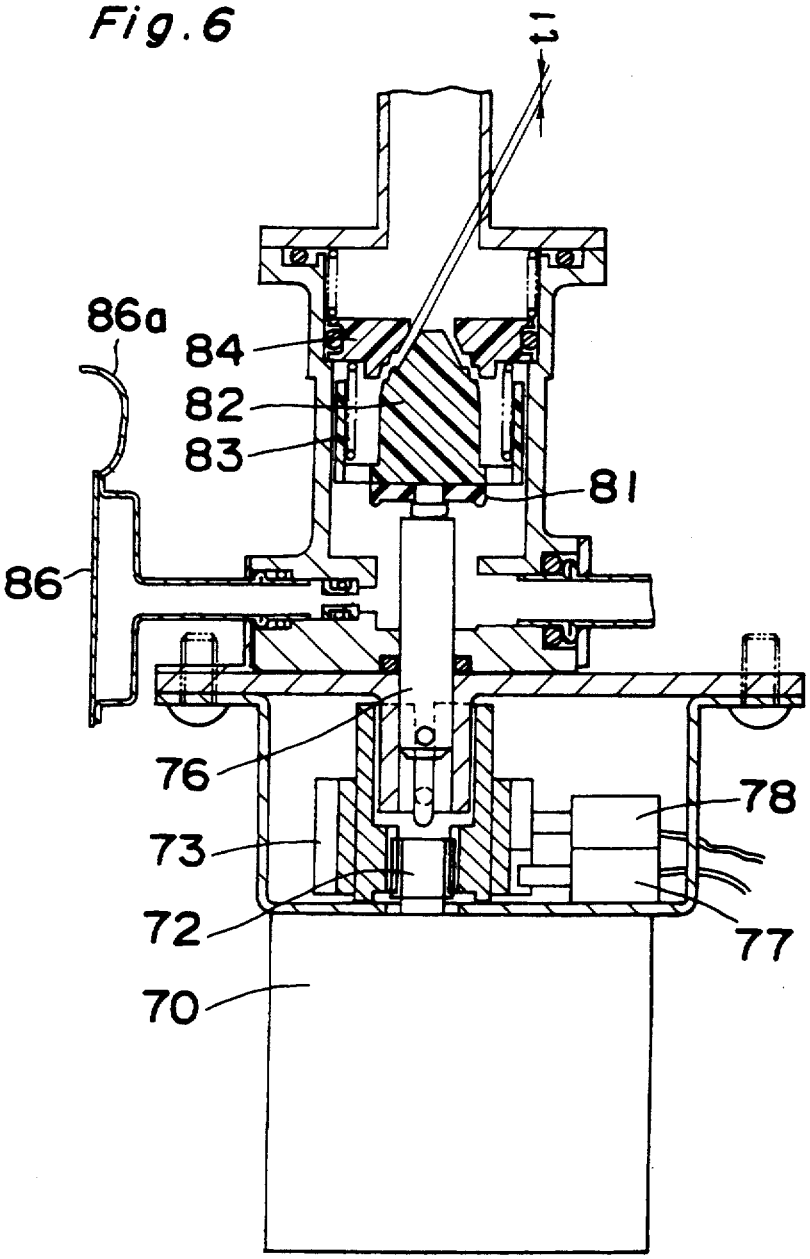
FIG. 6 is an enlarged sectional view showing the flow rate control means in the state in which thermal power is intermediate.
Figure 7:
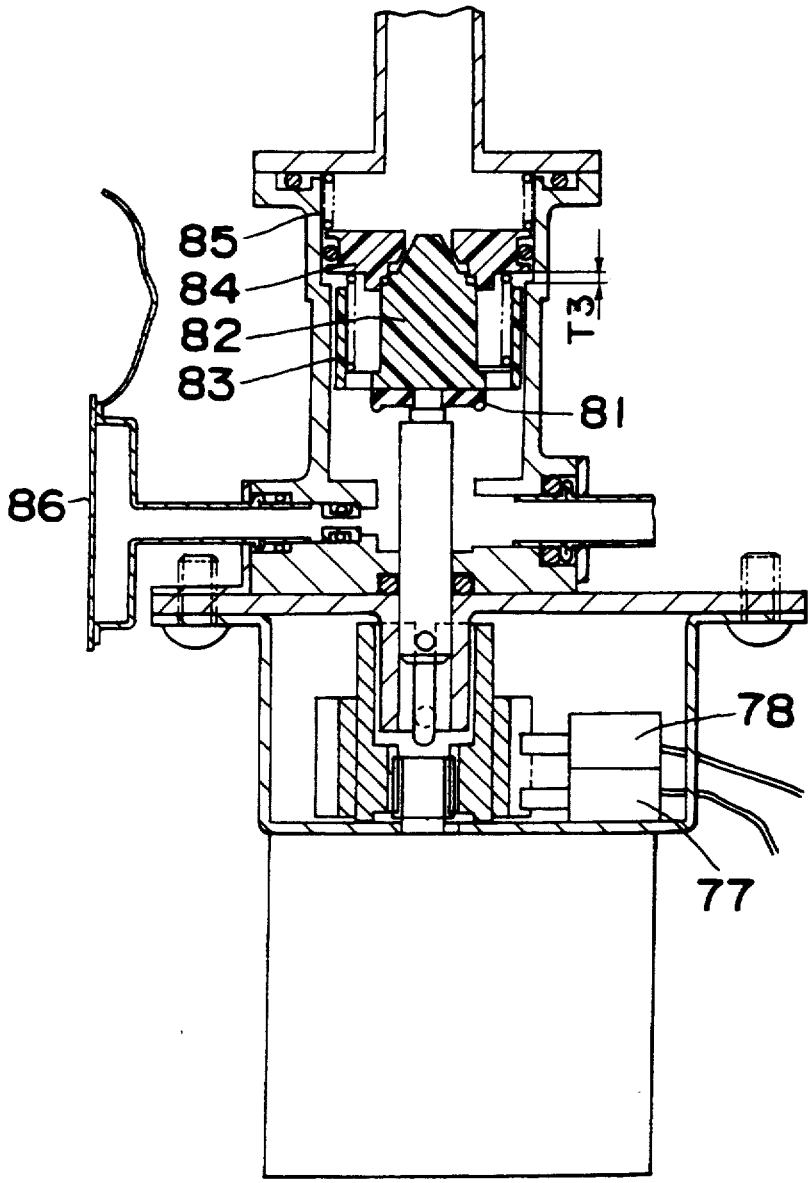
FIG. 7 is an enlarged sectional view showing the flow rate control means in the state in which burning amount is reduced to the minimum.
Figure 8:
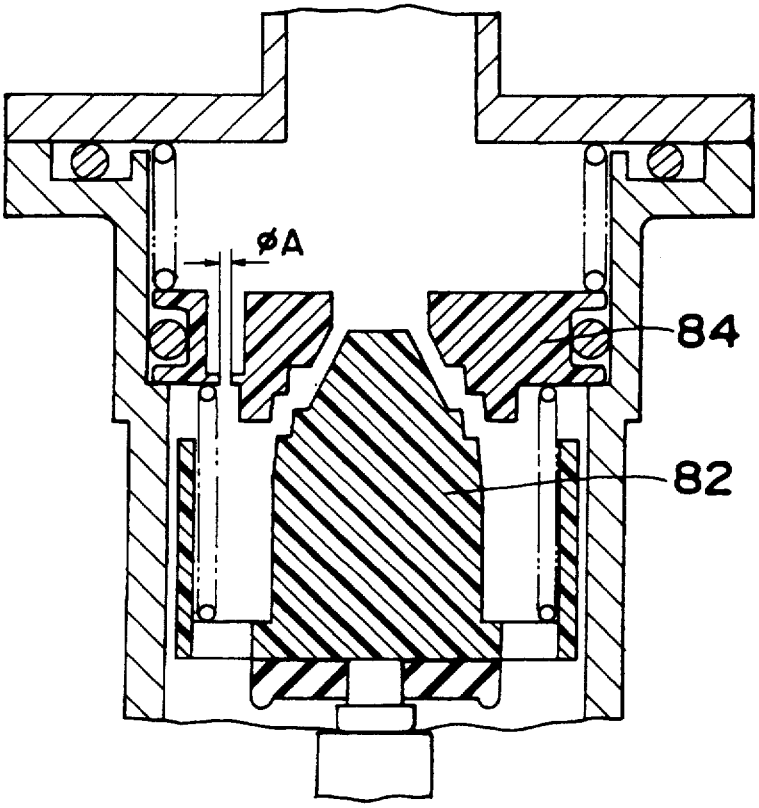
FIG. 8 is an enlarged view showing a reducing opening, of the flow rate control means, for reducing thermal power to the minimum.

A gas burning apparatus applied to a gas cooking apparatus according to an embodiment of the present invention is described below with reference to the drawings. FIG. 1 is a perspective view showing the gas burning apparatus used as the gas cooking apparatus according to an embodiment of the present invention. FIG. 2 shows the schematic construction of the gas control path of the gas burning apparatus and that of an electronic circuit 25 including a microcomputer 36. FIG. 3 is an enlarged view showing an operation panel 7. FIGS. 4 through 8 are views showing the operation of a flow rate control means 28. That is, FIG. 4 shows the state in which the operation thereof is stopped. FIG. 5 shows the state of the flow rate control means 28 in which thermal power is maximum. FIG. 6 is a minimum reducing position. FIG. 7 shows the state of the flow rate control means 28 in which burning amount is reduced to the minimum. FIG. 8 is an enlarged view showing a reducing mechanism 79 of the flow rate control means 28.

Figure 25:
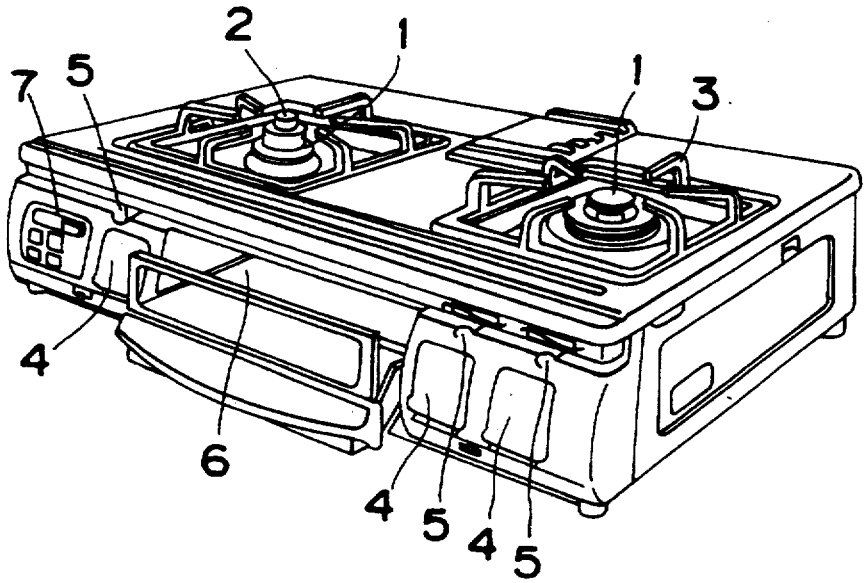
FIG. 25 is a perspective view showing a conventional gas cooking apparatus.
Figure 26:
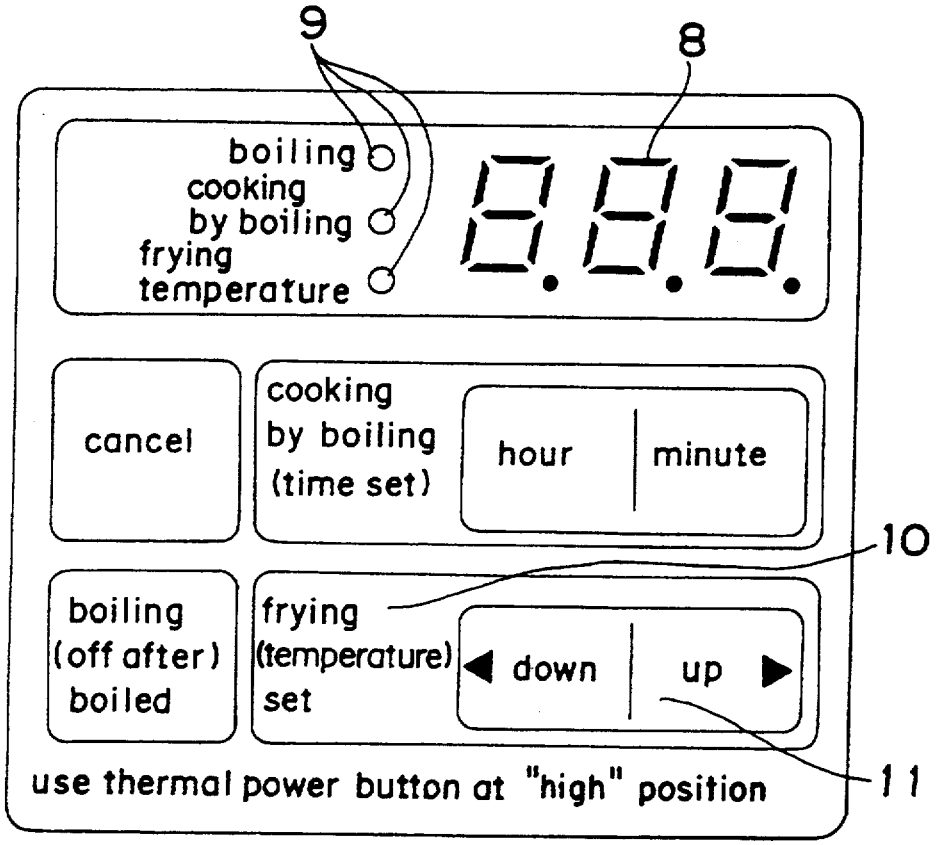
FIG. 26 is an enlarged view showing an operation panel of the conventional gas cooking apparatus.
Figure 27:
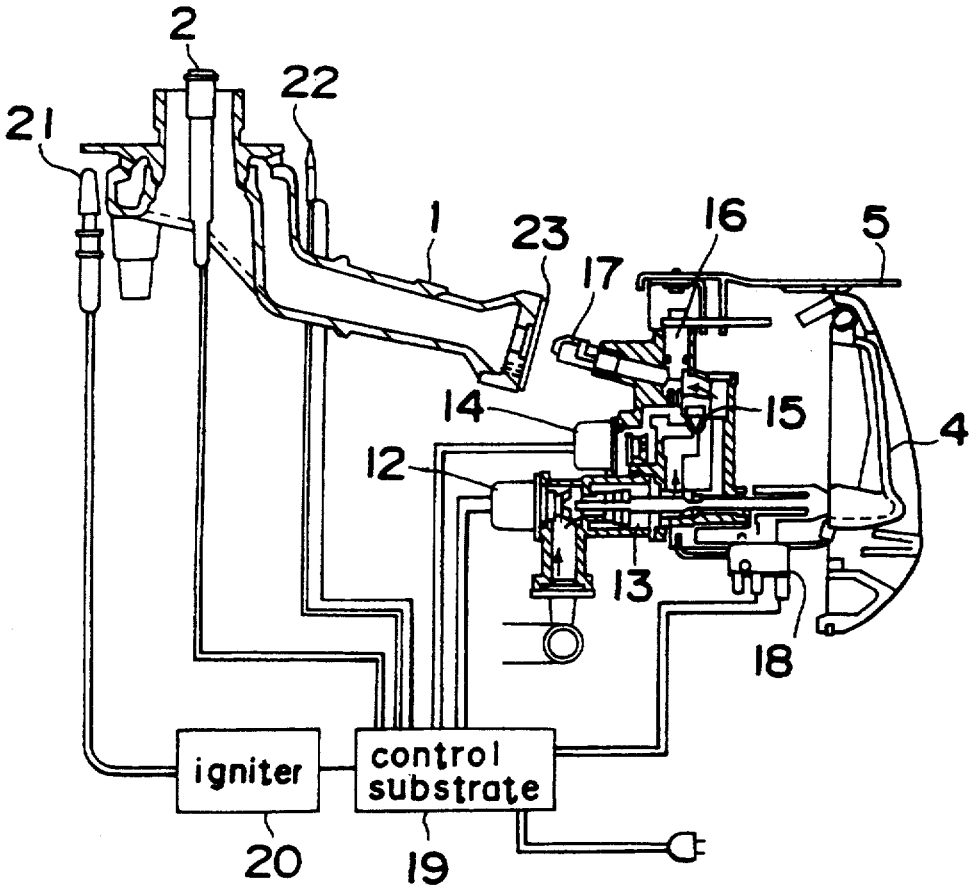
FIG. 27 is an explanatory view showing a conventional gas control apparatus.

Comparing FIG. 25 and FIG. 1 with each other, the gas cooking apparatus of the present invention does not include the ignition/extinction button 4 and the thermal power adjusting lever 5 unlike the conventional gas cooking apparatus. Therefore, the apparatus can be operated through the keys of the operation panel 7.

FIG. 2 is a block diagram showing the construction of the apparatus comprising a plurality of ovens, a heating section, a gas control block 24, the electronic circuit 25, a DC back-up power supply 35*a*, and the operation panel 7. In the heating section and the gas control block 24, gas passes through each flow rate control means 28 via a gas conduit 26 and a main cut-off valve 27, thus reaching a burner 1 via a gas pipe 29, a nozzle receiver 30, and a main nozzle 31 for regulating the maximum flow rate of gas. A temperature sensor 2, a thermocouple 32, and an ignition plug 33 are installed on the burner 1. The main cut-off valve 27, temperature sensor 2, the thermocouple 32, and the ignition plug 33 are connected with the electronic circuit 25 via a cut-off valve leading wire 27*a*, a temperature sensor leading wire 2*a*, a thermocouple leading wire 32*a*, and a high voltage leading wire 33*a*, respectively. The electronic circuit 25 comprises a power supply cord 34, a power supply circuit 35, the microcomputer 36, an operation/-display/I/O circuit 37, an alarm sound driving circuit 38, an operation lamp driving circuit 39, a calory change-over switch 40, a gas kind change-over switch 41, a continuous discharge igniter 42, a main cut-off valve driving circuit 43, and burning control blocks 44 corresponding to each burner. Each burning control block A44 comprises a temperature sensor A/D converting circuit 45, a motor driving circuit 46, a switch buffer circuit 47, a thermocouple electromotive force deciding circuit 48, and a pressure sensor converting circuit 49. The electronic circuit 25 includes a burning control block B50 and a burning control block C51 for each burner when the apparatus comprises three ovens.

FIG. 3 is an enlarged view showing the operation panel 7 comprising the display tube 8 displaying time and temperature; a time setting section 52 for inputting cooking period of time; an operation indicating section 55 of a left oven; a grill operation indicating section 60; and an operation indicating section 61 of a right oven. More specifically, the time setting section 52 comprises an hour key 53 and a minute key 54. The operation indicating section 55 comprises a plurality of light emitting diodes 56 for informing an operator of the condition of thermal power, an ignition/extinction key 57, an UP key 58 and a DWN key 59 for setting thermal power. The operation indicating section 61 has the same function (key) as that of the operation indicating section 55 and in addition, includes an automatic cooking function operation indicating section 62; a boiling mode 63 for automatically extinguishing flame by the operation of the temperature sensor 2 and the electronic circuit 25 after water is boiled; a boiling (cooking) mode 64 having a function of automatically estimating the amount and content of food to be boiled, automatically setting thermal power suitable for the cooking content after water is boiled, automatically extinguishing flame with the elapse of a set cooking period of time, and automatically extinguishing flame in priority of the set cooking period of time before the food is scorched; and a frying mode 65. For example, upon pressing an oil key 66, a frying mode lamp 67 is turned on. A desired temperature is set by pressing an UP key 68 or a DWN key 69 and the operator watches the display tube 8 so as to check whether the desired temperature has been set.

FIG. 4 shows the flow rate control means 28 comprising a geared motor 70; a geared motor leading wire 71; a relay joint 73 serving as a switch cam, for converting the rotational motion of the geared motor 70 into a linear reciprocating motion via a serration shaft 72 of the geared motor 70; a bearing 74 having a spiral slit formed thereon; a shaft 76 making a linear reciprocating motion and having a pin 75 formed on the lower end thereof to be inserted into the bearing 74; a switch A77; a switch B78; a switch leading wire A77*a;* and a switch leading wire B78*b*. These switches A77 and B78 compose a position deciding means. A reducing mechanism 79 comprises a valve body 80; a needle 82, constituting a valve, for controlling the flow rate of gas; a spring A83 for urging a valve 81 serving as a means for introducing and discharging gas; a needle receiver 84 opposed to the needle 82; and a spring B85 for supporting the needle receiver 84.

The flow rate control means 28 further comprises a pressure sensor 86; a pressure sensor leading wire 86*a;* and a bypass nozzle 88 for controlling the flow rate of gas flowing through the pressure sensor 86. These members serves as a means for detecting gas pressure.

The cam of the switches A77 of the relay joint 73 and that of the switch B78 thereof constituting the position deciding means have a configuration to discriminate from each other five stroke states which will be described later.

In the above-described construction, the power supply is connected with the electronic circuit 25, and the ignition/extinction key 57 of the operation panel 7 is operated to supply electric power from the cut-off valve driving circuit 43 to the main cut-off valve 27 to open it.

FIG. 5 is a sectional view showing the flow rate control means 28 in which burning is stopped. More specifically, FIG. 5 shows a third switch position (switch A77 is ON, switch B78 is ON, burning stop state). There is a gap (t) between the shaft 76 and the valve 81, and a valve seat 87 is pressed downward by a synthetic force of the springs A83 and B85. As a result, the valve 81 cuts off gas. The ignition/extinction key 57 is pressed in this state so that the motor driving circuit 46 transmits electrical energy to the geared motor 70 thereby to rotate the geared motor 70 forward. As a result, the relay joint 73 is rotated until the cam of the relay joint 73 is at a first switch position (switch A77 is OFF, switch B78 is ON, maximum thermal power position) via a second switch position (switch A77 is ON, switch B78 is OFF, moving state). As a result, the shaft 76 presses the valve 81 upward to move the valve 81 to the first switch position (maximum thermal power position). Microswitches are adopted in this embodiment, but rotary encoder type switches or optical type switches which are more expensive than mechanical type switches may be used.

Referring to FIG. 5, gas reaches the pressure sensor 86 from a gas conduit 26 via the gap t1 between the needle 82 and the needle receiver 84, the gap t2 between the valve 81 and the valve seat 87, and a bypass nozzle 88 and also reaches the burner 1 via the gas pipe 29, the nozzle receiver 30, and the flow rate regulating main nozzle 31. At this time, the continuous discharge igniter 42 shown in FIG. 2 is operated and as a result, a high voltage is supplied to the ignition plug 33 via the high voltage leading wire 33*a* in only a period of time set by the microcomputer 36. As a result, sparks are generated between the burner 1 and the ignition plug 33, and then, gas starts burning. Thereafter, the thermocouple 32 is heated by the flame of the burner 1. In this manner, gas keeps burning. The pressure sensor 86 is pressurized by gas pressure, thus transmitting a pressure change to the pressure sensor converting circuit 49 via the sensor leading wire 86*a*. At the first switch position ((maximum thermal power position), since the gap t2 between the valve 81 and the valve seat 87 is sufficient, gas pressure indicates the maximum value.

FIG. 6 is a sectional view showing the flow rate control means 28 in the state (zeroth switch position) in which the minimum gas pressure is set by the DWN key 59. In this state, the gap t1 between the needle receiver 84 and the needle 82 is small to increase resistance to the flow rate of gas. In this manner, the flow rate of gas is reduced. At the zeroth switch position (thermal power adjusting state), the switch A77 is OFF, switch B78 is OFF. That is, the pressure sensor 86 is pressurized, thus transmitting a pressure change to the pressure sensor converting circuit 49 via the sensor leading wire 86*a*. As a result, a gas pressure deciding means 93 which will be described later adjusts the gap t1 between the needle receiver 84 and the needle 82 so as to obtain the set gas pressure.

FIG. 7 is a sectional view showing the flow rate control section 79 at the second switch position (maximum operation point). If the pressure sensor 86 is incapable of adjusting gas pressure to a set minimum gas pressure at the zeroth switch position because foreign matter has penetrated into the needle portion or the like, gas pressure is adjusted to be low. As a result, the needle 82 operates in a direction in which the gap t1 between the needle 82 and the needle receiver 84 is reduced and the gas pressure cannot be adjusted to the minimum set gas pressure. Consequently, the needle 82 does not stop operation when the needle 82 is brought into contact with the needle receiver 84 under pressure in this state. As a result, the geared motor 70 is broken. In order to prevent this state from occurring, a shock absorbing device for securing a stroke t3 is provided to maintain the state in which the needle 82 is in contact with the needle receiver 84 under pressure, and the maximum operation point of the movable range of the needle 82 is set so that the needle 82 stops at the second switch position (maximum operation point) even though the minimum gas pressure cannot be obtained.

FIG. 8 is an enlarged sectional view showing the needle 82 and the needle receiver 84. The needle portion is not tapered but stepped. The flow rate control is determined by the combination of an area change and the change in the resistance to flow velocity, and there is provided a flow rate regulating opening $\phi A$ ($\phi 0.2$ to 0.4) through which gas flows at a minimum reduction rate of approximately 300 kcal/h of LPG. 14.

FIG. 9 shows the outline of various deciding means of the central control means 36 of the gas burning apparatus. The central control means 36 comprises a service interruption deciding means 89; a gas kind setting means 90; a thermal power setting means 91; a means 92 for deciding on the display of the state of gas cooking apparatus; a gas pressure deciding means 93; a position deciding means 94; an equilibrium temperature deciding means 95; an abnormal temperature deciding means 96; drive deciding means 97; an integrated drive deciding means 98; a display means 99; a flow rate control means 100; a heating means 101; the gas pressure sensor 86; a temperature detecting means 102; a means 103 for cutting off a high gas pressure; a means 104 for deciding on the abnormality of the pressure of supplied gas; a means 105 for deciding on the compensation of zeroth gas pressure; and an alarm means 106.

Figure 10:
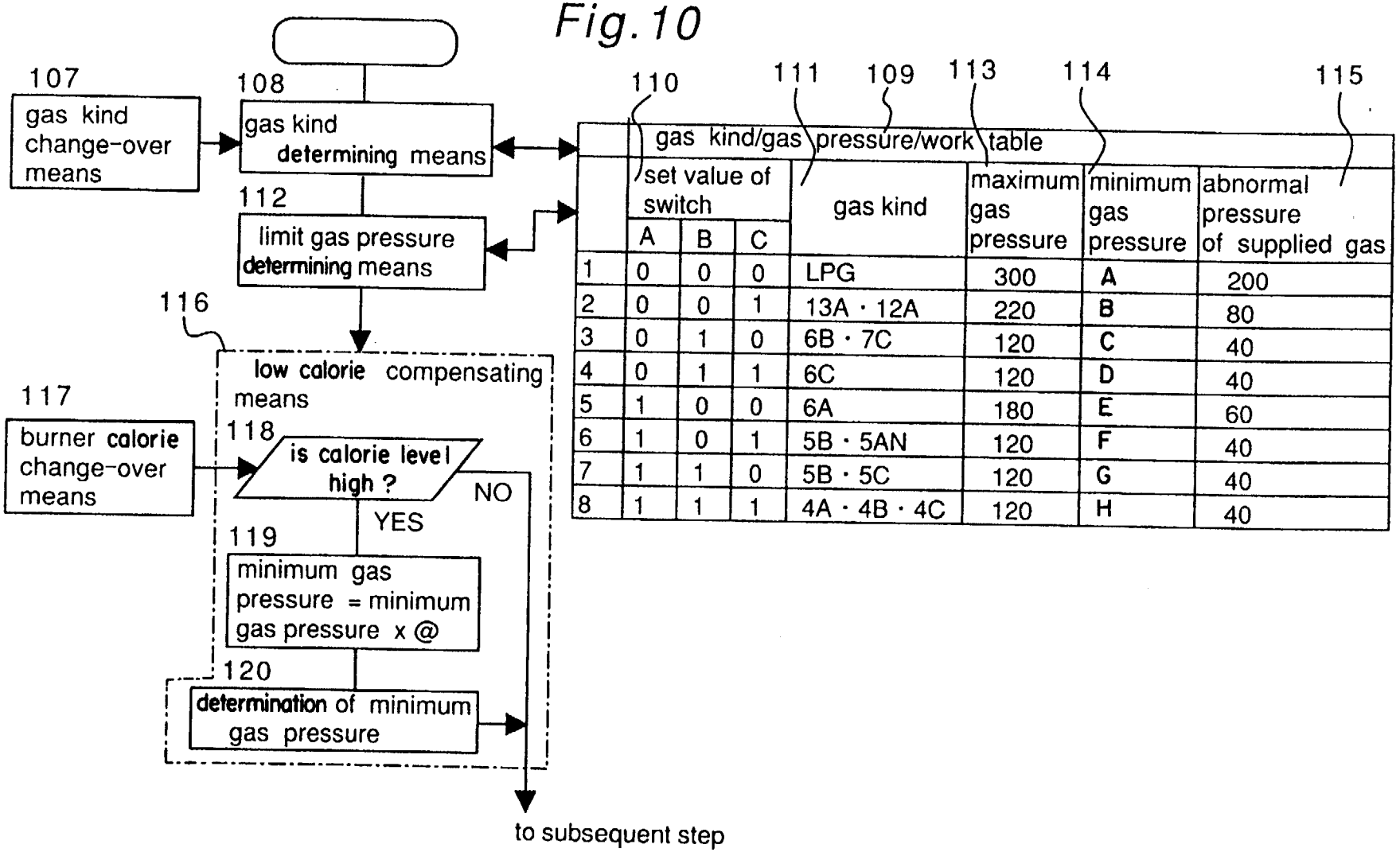
FIG. 10 is a view showing the content of gas kind setting means.

FIG. 10 shows the content of the gas kind setting means 90. The kind of gas is selected by a gas kind change-over means 107 capable of discriminating from each other a plurality of kinds of gases. For example, eight modes can be decided by a three-gang switch of ON and OFF. The content of the selected gas is discriminated by a gas kind deciding means 108. Based on the set values 110 of the switches of the work table, a limit gas pressure deciding means 112 decides a maximum gas pressure 113, a minimum gas pressure 114, and an abnormal pressure 115 of supplied gas from a gas kind/gas pressure work table 109 stored in the storing section. For example, if the set values 110 of the switches A, B, and C are all OFF, the gas kind 111 is LPG; the maximum gas pressure is 300 $mmH_2O$; the minimum gas pressure 114 is set to be (A)$mmh_2O$; and the abnormal gas pressure 115 of supplied gas is 200 $mmH_2O$.

The maximum gas pressure 113 is a value obtained by adding the standard gas pressure of each gas group provided by law and an error of such as the gas sensor 86 to each other. The purpose of the use of the maximum using gas pressure 118 is described later. The set minimum gas pressure 114 is proportional to the minimum burning amount of the burner 1.

$$Q = * \times D \hat{} 2 \times \sqrt{H} / d$$

Q=flow rate of gas

*=coefficient determined for each kind of gas

D ^ 2=passage area of gas

H=gas pressure d=specific gravity determined for each kind of gas

The minimum burning capability of the burner 1 changes according to the characteristic of a burner and a gas group. If the burning amount is too small, combustion load becomes too small and as a result, backfire occurs while the flow rate of gas is being reduced to extinguish flame. In order to prevent such a problem from occurring, the minimum gas pressure 114 is set for each gas group based on experimental results. The abnormal pressure 115 of supplied gas is obtained by subtracting an error of such as the pressure sensor 86 from the lowest gas pressure of each gas group provided by law. The purpose of the use of the minimum using gas pressure 114 is described later. In order for a weak calory compensating means 117 to determine the minimum calory of each burner, it is decided at step 118 whether the calory of each burner generated when each burner burns gas to the maximum set by a burner calory change-over means 117 (in this embodiment, larger and smaller modes are set) is great or small. If it is decided that the calory is great, the minimum burning amount of the larger mode is set to be higher than the minimum burning amount of the smaller mode in view of the burning characteristic of burners so as to prevent flame from being extinguished. That is, the set minimum gas pressure 114 is multiplied (at step 119) by a gas pressure compensating coefficient $\alpha$ so as to set the minimum gas pressure to be higher (at step 120). Although the required number of the burner calory change-over means 117 is not shown in FIG. 10, the required number thereof is equal to that of burners. In addition to the above-described method, the gas kind setting means 90 and the limit gas pressure deciding means 112 perform the functions thereof and minimum pressure for each burner is determined as follows: That is, the condition of the kind of gas to be used is written on EPROM by using the keys of the operation panel 7 so as to be suitable for new burners.

Figure 11:
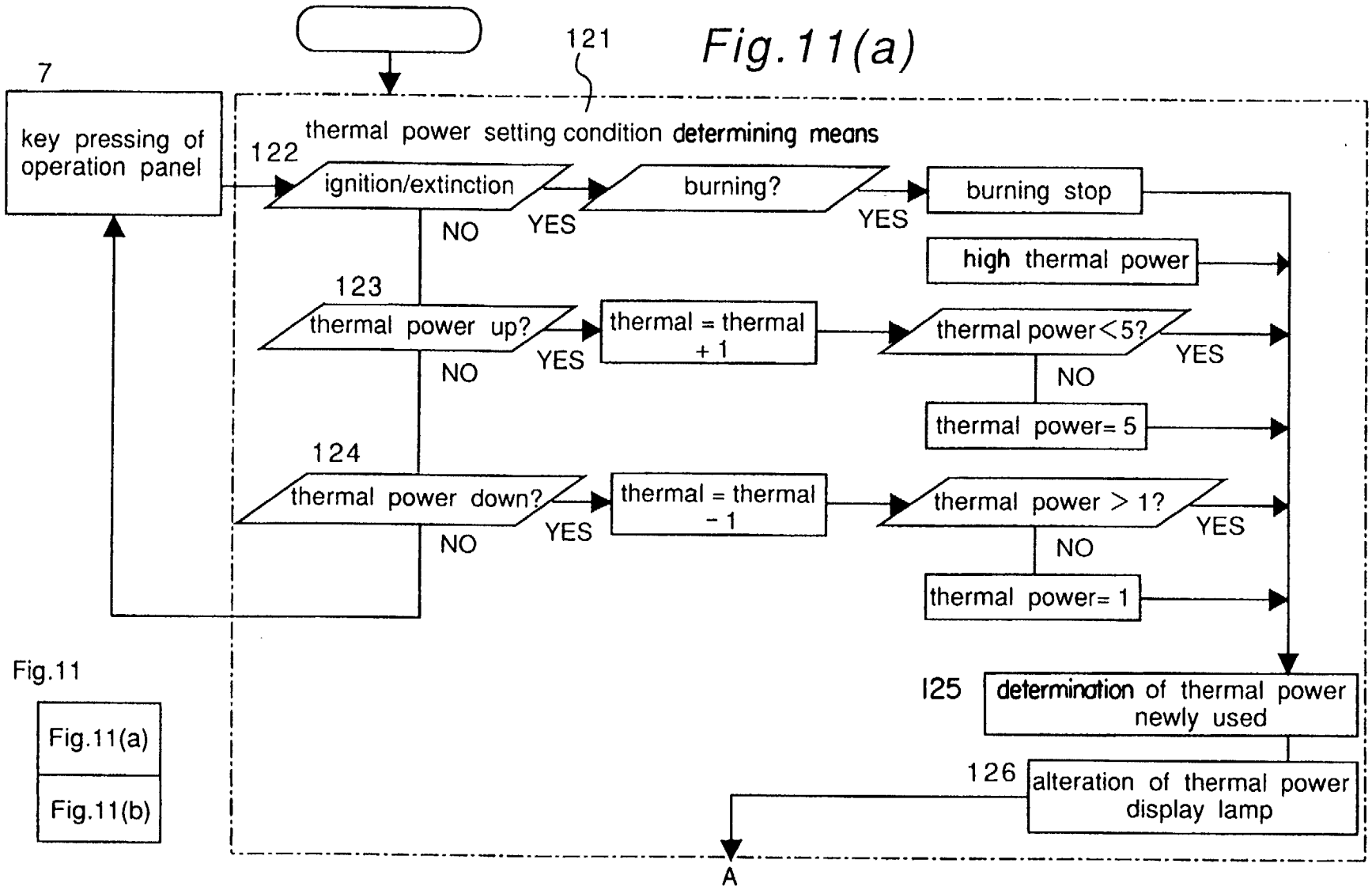
FIG. 11 is a key to the reconstruction of FIGS. 11(*a*) and 11(*b*)
Figure 11B:
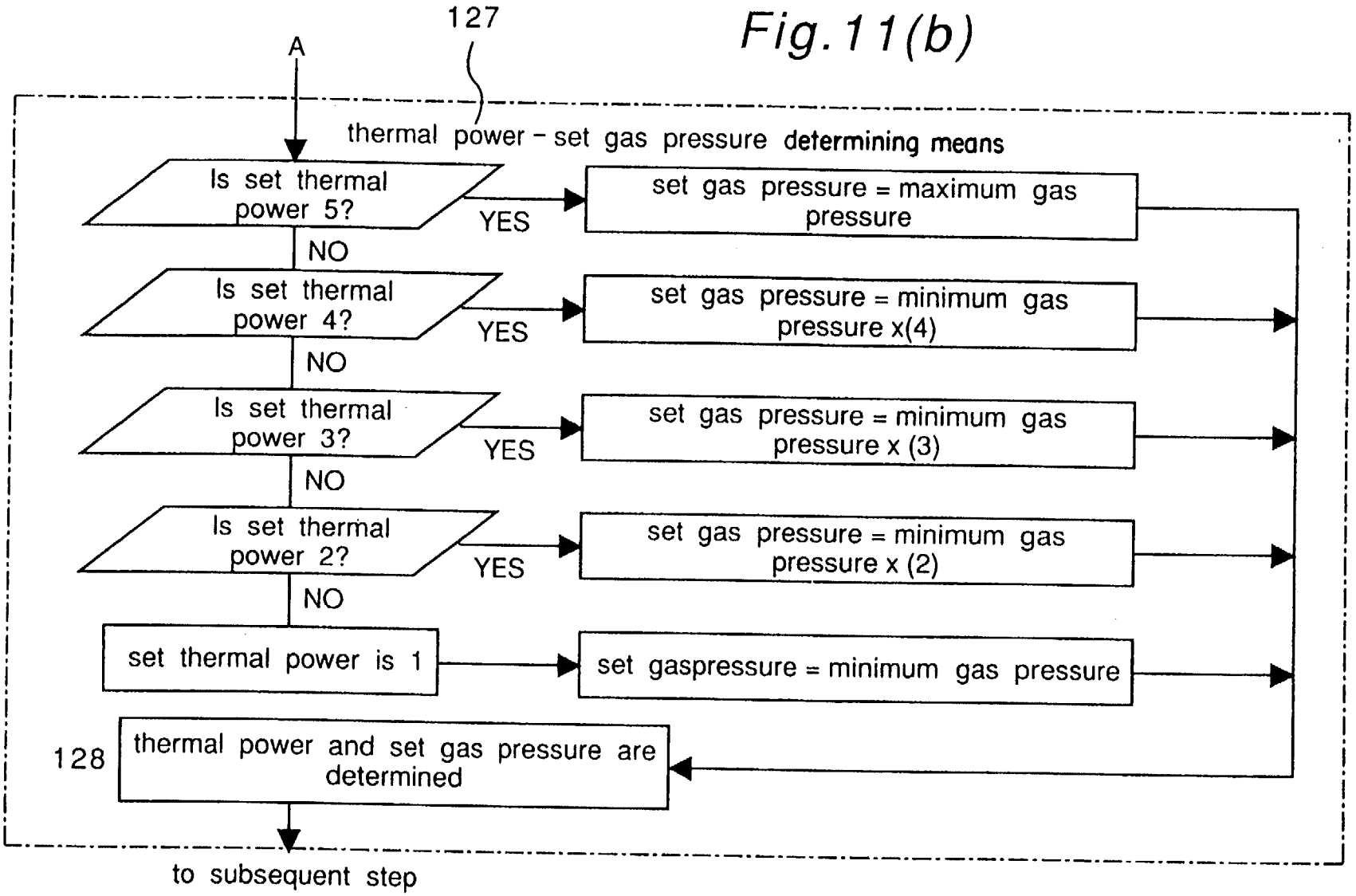

FIG. 11 shows the content of the thermal power setting means 91. A thermal power setting condition deciding means 121 compares/decides about the input of the condition of thermal power by means of various keys of the operation panel 7, for example, the ignition-/extinction key 57, the UP key 58, and the DWN key 59. That is, the thermal power setting condition deciding means 121 decides whether fire is ignited or extinguished (at step 122), whether thermal power is increased or decreased (at steps 123 and 124), and decides about thermal power used newly, in consideration of the current use condition (at step 125), and turns on the thermal power display lamps 56 according to set thermal power (at step 126). For example, if the thermal power display lamps 56 makes a display in five stages, they are turned on as follows:

| display lamp | set thermal power |
|---|---|
| 5 are turned on | thermal power 5 (maximum) |
| 4 are turned on | thermal power 4 |
| 3 are turned on | thermal power 3 |
| 2 are turned on | thermal power 2 |
| 1 is turned on | thermal power 1 (minimum) |

Based on the decision (at step 125) of the new thermal power, a means 127 for deciding thermal power/the set pressure decides a gas pressure according to a set thermal power. An example is shown below.

| set thermal power | set gas pressure (128) | target burning calory Kcal/h | remark (approximate target coefficient value) |
|---|---|---|---|
| 5 | pressure of supplied gas | 2800 | |
| 4 | set minimum gas pressure × (4) | 1200 | (4) = 9 |
| 3 | set minimum gas pressure × (3) | 800 | (3) = 4 |
| 2 | set minimum gas pressure × (2) | 500 | (2) = 1.56 |
| 1 | set minimum gas pressure | 400 | |

The means 127 for deciding thermal power/set pressure calculates a gas pressure for each thermal power, thus sending the information of ignition, extinction, the set thermal power, the set gas pressure 128 (at step 128) to a subsequent stage. The reason the gas pressure is set based on the minimum gas pressure 114 is because when calory is weak (low), the same calory is required for each time, and thus the gas pressure is determined by the above-described coefficient.

FIG. 12 shows the content of the gas pressure deciding means 93. Pressure distortion is generated in the pressure sensor 86 when the gas-receiving surface thereof is pressurized. The pressure sensor 86 converts the pressure distortion into an electric signal. A pressure converting means 130 calculates the secondary gas pressure based on a coefficient stored in a constant storing section 129 by means of the electric signal.

In order to decide the secondary gas pressure, a secondary gas pressure calculating/processing means 132 adds to each other the calculated gas pressure and zeroth gas pressure compensation value (zeroth gas pressure compensation value is 0 at an early period of time of use of gas) stored in a storing section 131, for storing compensation value of zeroth gas pressure, which will be described later. A means 133 for setting thermal power/comparing the secondary gas pressure calculates the absolute value of the gas pressure difference between the decided secondary gas pressure and the gas pressure 128 set by the thermal power setting means 91. It is decided at step 134 whether or not the absolute value of the gas pressure difference is smaller than the product of the set gas pressure 128 and a coefficient $\gamma$ (for example 10%). If yes, a signal 135 for stopping the operation of the flow rate control means 100 is transmitted to a subsequent stage. If no, it is decided at step 136 whether or not the absolute value of the gas pressure difference is smaller than the product of the set gas pressure 128 and a coefficient $\delta$ (for example 150%). If yes, a signal indicating that the drive speed of the flow rate control means 100 is set to be low is transmitted to a subsequent stage (at step 137). If no, a signal indicating that the drive speed of the flow rate control means 100 is set to be high is transmitted to a subsequent stage (at step 138) and then, in order to instruct the drive direction, it is decided at step 139 whether the difference between the decided secondary gas pressure and the set pressure corresponding to a desired thermal power is positive or negative. If positive, the information of forward rotation (at step 140) is transmitted to a subsequent stage. If negative, the information of backward rotation (at step 41) is transmitted to the subsequent stage.

In addition to the above-described thermal power setting means, the following means is regarded as thermal power setting means having the following function in boiling (cooking) mode 64 for automatically cooking food with the temperature of the bottom of a pan containing the food being detected by the temperature sensor 2. That is, means automatically estimating the amount of the food and the content thereof; automatically setting thermal power suitable of the cooking content after water is boiled; automatically extinguishing flame with the elapse of cooking period of time set in advance, automatically extinguishing flame in priority of the set cooking period of time before the food is scorched.

Figure 13:
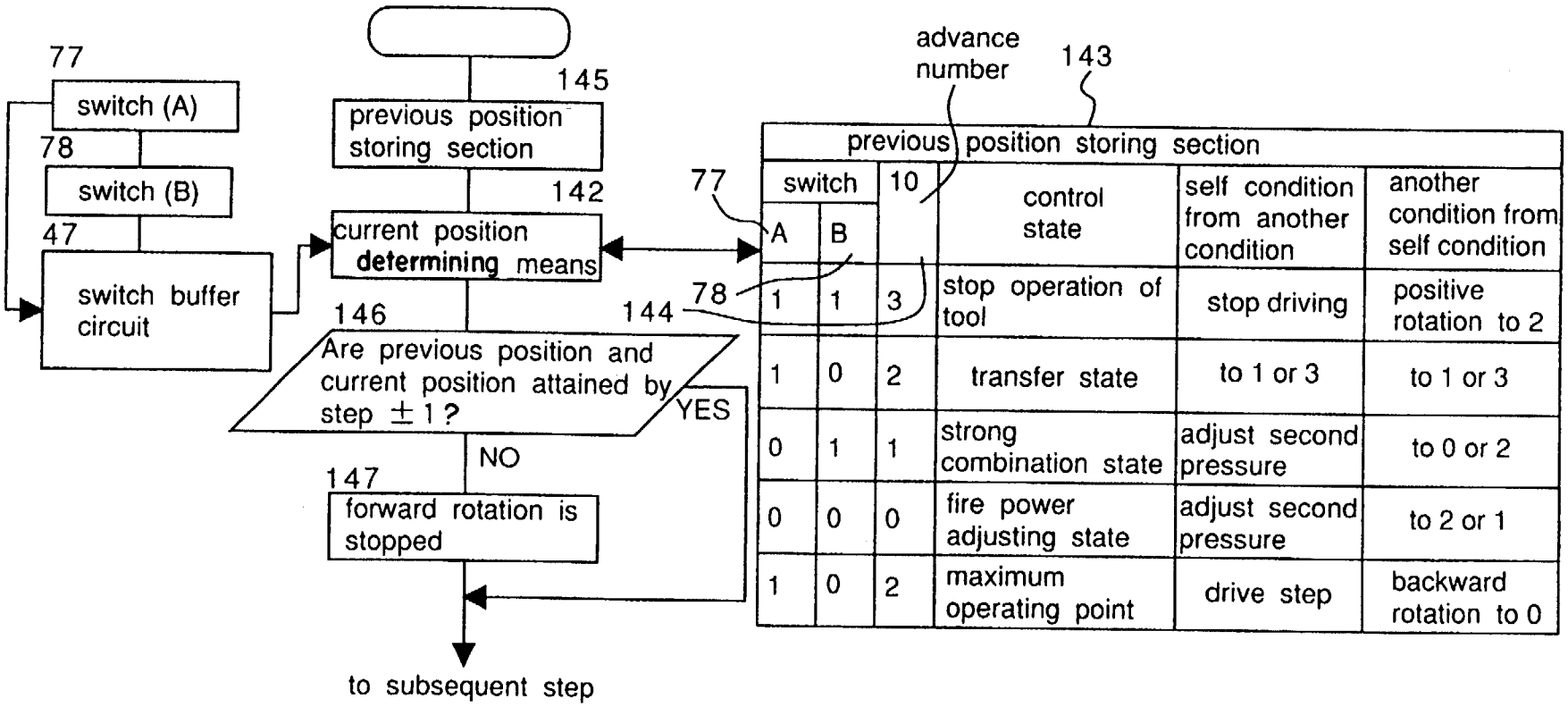
FIG. 13 is a view showing the content of position deciding means.

FIG. 13 shows the content of the position deciding means 94. The ON and OFF signals of the switches A77 and B78 are stored in a current position deciding means 142 via the buffer circuit 47. The current position deciding means 142 converts the levels of the signals into OCT indication (decimal number indication 144) according to the ON and OFF of the switches A77 and B78 of a work table 143 serving as a switching deciding means. The states of switches A77 and B78 are discriminated in five states, namely, switch position 3 [gas cooking apparatus stop state (switches A77 and B78 are ON)], second switch position [transition state (switch A77 is ON and switch B78 is OFF, transition from operation stop of gas cooking apparatus to maximum thermal power)], first switch position [maximum thermal power state (switch A77 is OFF and switch B78 is ON)], zeroth switch position [thermal power adjusting state (switches A77 B78 are OFF)]; and second switch position [maximum operation point (switch A77 is ON and switch B78 is OFF)]. The state of the second switch position is used two times in the above. In the display of the switch position of the previous state and current state, the change of "2" occurs only when the zeroth switch position (thermal power adjusting state) changes to the second switch position (maximum operational point) while in other cases, the switch position changes by one step. The position deciding means 94 comprising a previous position storing section 145 discriminates two-step change at step 146. In the case of two-step change, a drive for a forward rotation is stopped at step 147. Although two switches are used in this embodiment, three switches may be used to discriminate the switch position.

FIG. 14 shows the content of the drive deciding means 97. If it is decided at step 148 that the thermal power setting means 91 sets the movement indication to extinction, the difference between the extinction position (third switch position) and the current position (for example, zeroth switch position) is found at step 149 until the extinction position (third switch position of the position deciding means 94) is obtained. It is decided at step 150 whether the difference exceeds "1" or not. If the difference exceeds "1", the drive speed is set to be high. If the difference does not exceed "1", the drive speed is set to be low and the rotational direction is set to be reverse (at step 153). When the extinction position is attained (at step 149), the drive is stopped and the program goes to the steps of the means 105 for deciding on the compensation of zeroth gas pressure.

If it is decided at step 148 that the thermal power setting means 91 does not set the movement indication to extinction, it is decided at step 155 whether or not the moving indication is thermal power 5 (first switch position, maximum thermal power). If yes, the difference ($|1-3|=2$) in the absolute value between the thermal power 5 (first switch position) and the current position (for example, third switch position) is found until the current position becomes the thermal power 5 (first switch position). It is decided at step 157 whether the difference exceeds "1" or not. If the difference does not exceed "1", the drive speed is set to be high (at step 158). If the difference exceeds "1", the drive speed is set to be low (at step 159), and it is decided whether the difference between the current position (for example, third switch position) and the thermal power 5 (first switch position) is equal to "1" or greater than "1" ($1-3=-2$) (at step 160). If yes, the rotational direction is set to be reverse (at step 161). If no, the rotational direction is set to be forward (at step 162). When the thermal power 5 (first switch position) is attained, the drive is stopped and the program goes to the subsequent step.

If the moving indication is not the thermal power 5 (at step 155), it is decided at step 164 whether or not moving indication is thermal power 1~4. If yes, it is decided at step 165 whether or not the switch position is "0". If yes, the drive condition is set at step 166 based on the content decided by the gas pressure deciding means 93. If no, it is decided at step 167 whether the previous switch position stored in the previous position storing section 145 of the position deciding means 94 is "0". If the previous switch position is not "0", the motor is rotated until the switch position becomes 0 (at step 168). If the previous switch position is "0", it is decided at step 169 whether or not the switch position is "2". If the switch position is "2", it is driven (at step 171) in dependence on the means 133 for setting thermal power/comparing and deciding the secondary gas pressure when the set gas pressure is lower than the secondary gas pressure (at step 170). If the set gas pressure is greater than the secondary gas pressure, the drive-stopped state continues. If the switch position is not "2" (at step 169), it is decided at step 17S whether the set gas pressure is lower than the secondary gas pressure. If yes, it is driven (at step 174) in dependence on the means 133 for setting thermal power/comparing and deciding the secondary gas pressure. If no, the it moves to the zeroth switch position (at step 175).

FIG. 15 shows the content of the means 104 for deciding on the abnormality of the pressure of supplied gas. When the switch position is "1" (maximum thermal power state) and X minutes have elapsed (at step 176), it is decided at step 177 whether the secondary gas pressure is less than the abnormal pressure 115 for each kind of gas set by the gas kind setting means 90. If yes, the alarm means 106 informs an abnormal gas pressure (at step 178).

FIG. 16 shows the content of the means 105 for deciding on the compensation of zeroth gas pressure. When the switch position is 3 (extinction state) (at step 179), it is decided at step 180 whether the absolute value of the secondary gas pressure supplied by the gas pressure deciding means 93 is greater than a constant K1. If no, a compensation is not made. If yes, it is decided at step 181 whether the absolute value of the secondary gas pressure is smaller than a constant K2. If no, the alarm means 106 informs the result at step 182. If the absolute value of the secondary gas pressure is greater than a constant K3, the operations of the gas burning apparatus is stopped at step 182*a*. If the absolute value of the secondary gas pressure is K1~K2, the absolute value is stored in the storing section 131, for storing compensation value of zeroth gas pressure, of the gas pressure deciding means 93 as the compensation value thereof.

FIG. 17 shows the content of the means 103 for cutting off a high gas pressure. If it is decided at step 184 that it is higher than the maximum gas pressure when thermal power is maximum (first switch position). If yes, the means 103 for cutting off a high gas pressure issues an instruction for moving the switch position to "0" (at step 185), and the thermal power of the means for deciding thermal power/deciding set gas pressure is altered; the value of the thermal power of the set gas pressure 128 is altered to "4"; and the set gas pressure is altered to the maximum gas pressure 113. Then, the program does not go to the thermal power setting means but goes to the gas pressure deciding means 93. Accordingly, the switch position is "0", and the state displayed by the thermal power display lamp 56 is thermal power 5. At this time, the set thermal power is 4 (zeroth switch position). When the thermal power DWN key 59 of the operation panel 7 is pressed, the thermal power setting means 91 sets a normal state (four lamps are turned on; set gas pressure is minimum gas pressure ×(4)).

FIG. 18 shows the content of the integrated drive deciding means 98. It is decided at step 187 by the drive deciding means 97 which of the ovens is driven at a low speed at zeroth switch position (thermal power adjusting state). If any one of the ovens is driven at a low speed at zeroth switch position, it is decided at step 188 whether the other ovens are being driven at a low speed at the zeroth switch position. If yes, the driving means of the ovens are temporarily stopped (at step 189), and the information is stored in the temporary stop storing device (at step 190). If no ovens are driven at a low speed (at step 187), it is decided at step 191 whether there is an oven which has temporarily stopped at zeroth switch position. If yes, the content stored in the temporary stop storing device is erased (at step 192) and a re-drive is effected.

Figure 19:
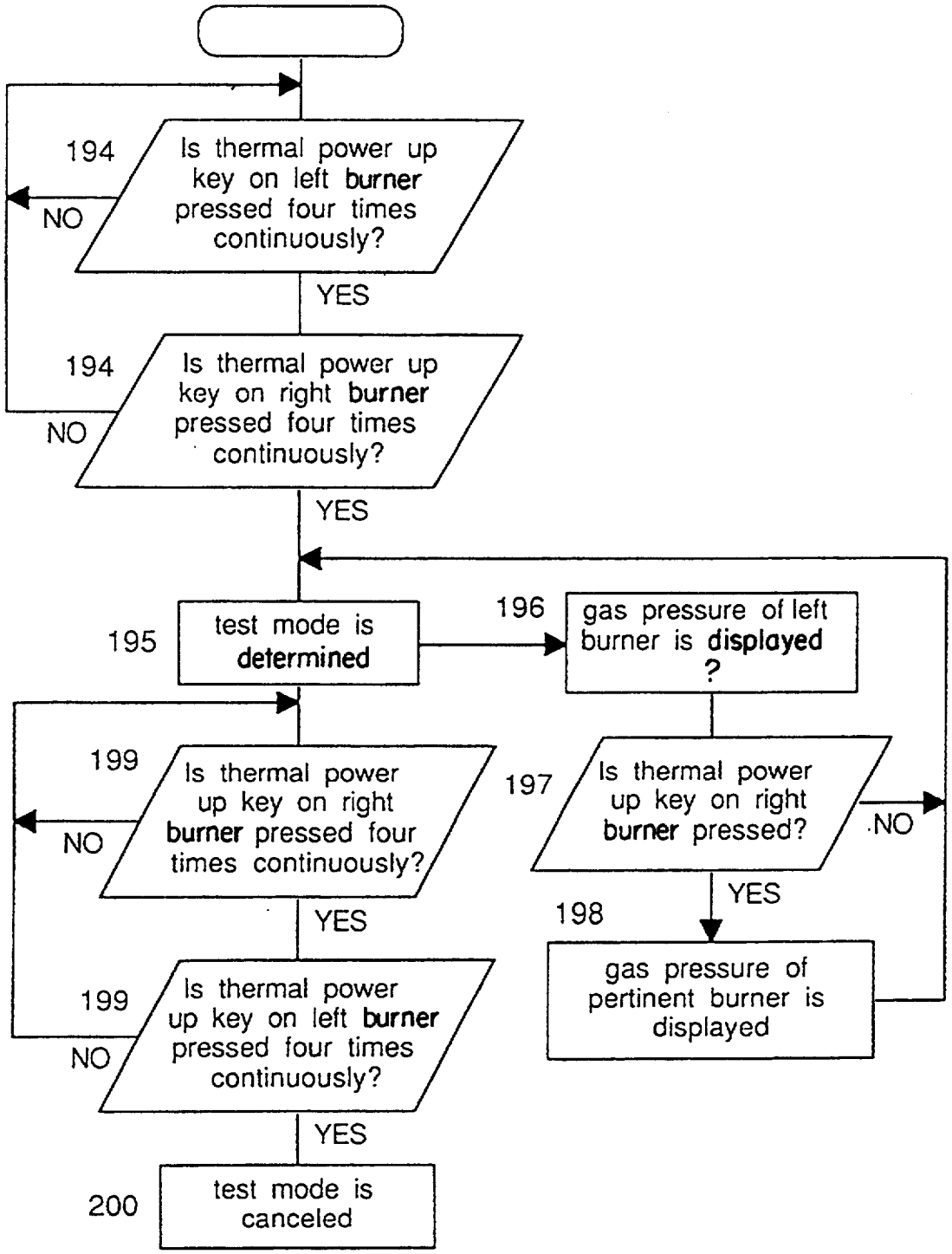
FIG. 19 is a view showing the content of means for deciding on the display state of a gas cooking apparatus.

FIG. 19 shows the content of the means 92 for deciding on the display of the state of the gas cooking apparatus. Appropriate articular keys are pressed (at step 194) a plurality of times to obtain a test mode (at step 195). In this state, the secondary gas pressure at the left burner is displayed on the display portion 8 of the display means 99. When the thermal power UP key is pressed (at step 197), the secondary gas pressure at a pertinent burner is displayed (at step 198). Then, the test mode is canceled (at step 200) by turning off the power source or pressing an appropriate key a plurality of times (at step 199).

Figure 20:
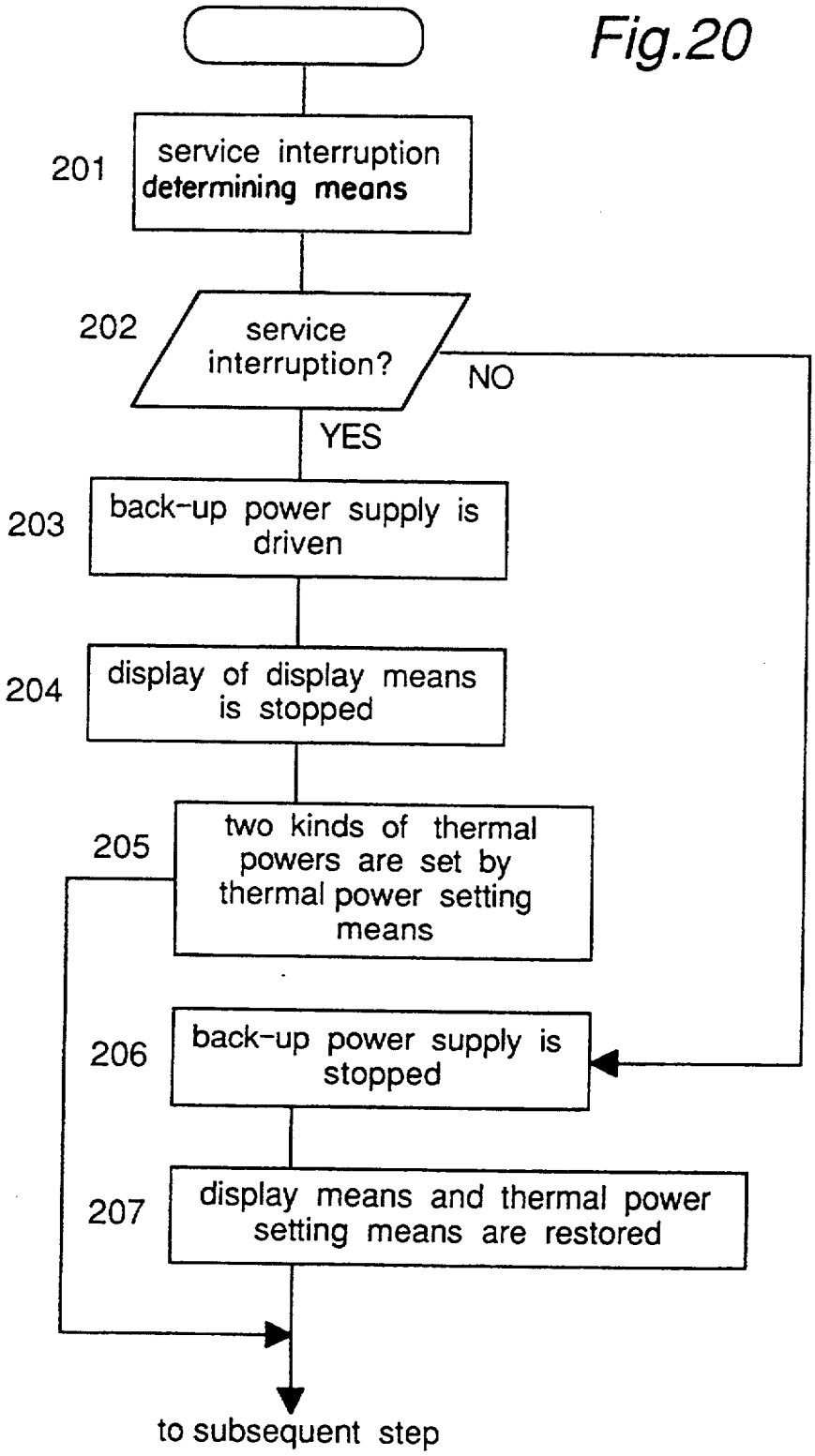
FIG. 20 is a view showing the content of service interruption deciding means.

FIG. 20 shows the content of the service interruption deciding means 89. It is decided at step 202 whether the electric current has been interrupted in response to a signal outputted from a service interruption deciding circuit 201 of the power circuit 35. If yes, a back-up power supply 35*b* is driven (at step 203) to supply electric power to the electronic circuit 25. Then, at step 204, the display of the display means 99 is stopped, and two kinds (strong thermal power and weak (low) thermal power) of thermal powers are set by the thermal power setting means 91 at step 205. (Detailed description is omitted. The adding number of the thermal power setting means 91 shown in FIG. 11 in increasing thermal power is altered from "1" to "5", and the subtracting number thereof in decreasing thermal power is altered from "1" to "5"). Then, the program goes to a subsequent step. When the service interruption has stopped, the back-up power supply 202 is stopped at step 206, and the display means and the thermal power setting means are restored at step 207.

FIG. 21 shows the content of the equilibrium temperature deciding means 95. It is decided at step 208 whether the current thermal power position is thermal power 5 (maximum) or the current thermal power is greater than a set gas pressure corresponding to thermal power 4. If yes, it is decided at step 209 whether or not X1 minutes have elapsed after the current thermal power position becomes thermal power 5. If yes, it is decided at step 210 whether or not the temperature of the temperature detecting means 102 for detecting the temperature of the temperature sensor 2 is smaller than K1° C. If yes, it is decided at step 211 whether or not the difference between the current temperature and the temperature X2 seconds prior to the current time is less than T1° C. If yes, an extinction display is made at step 212.

Figure 22:
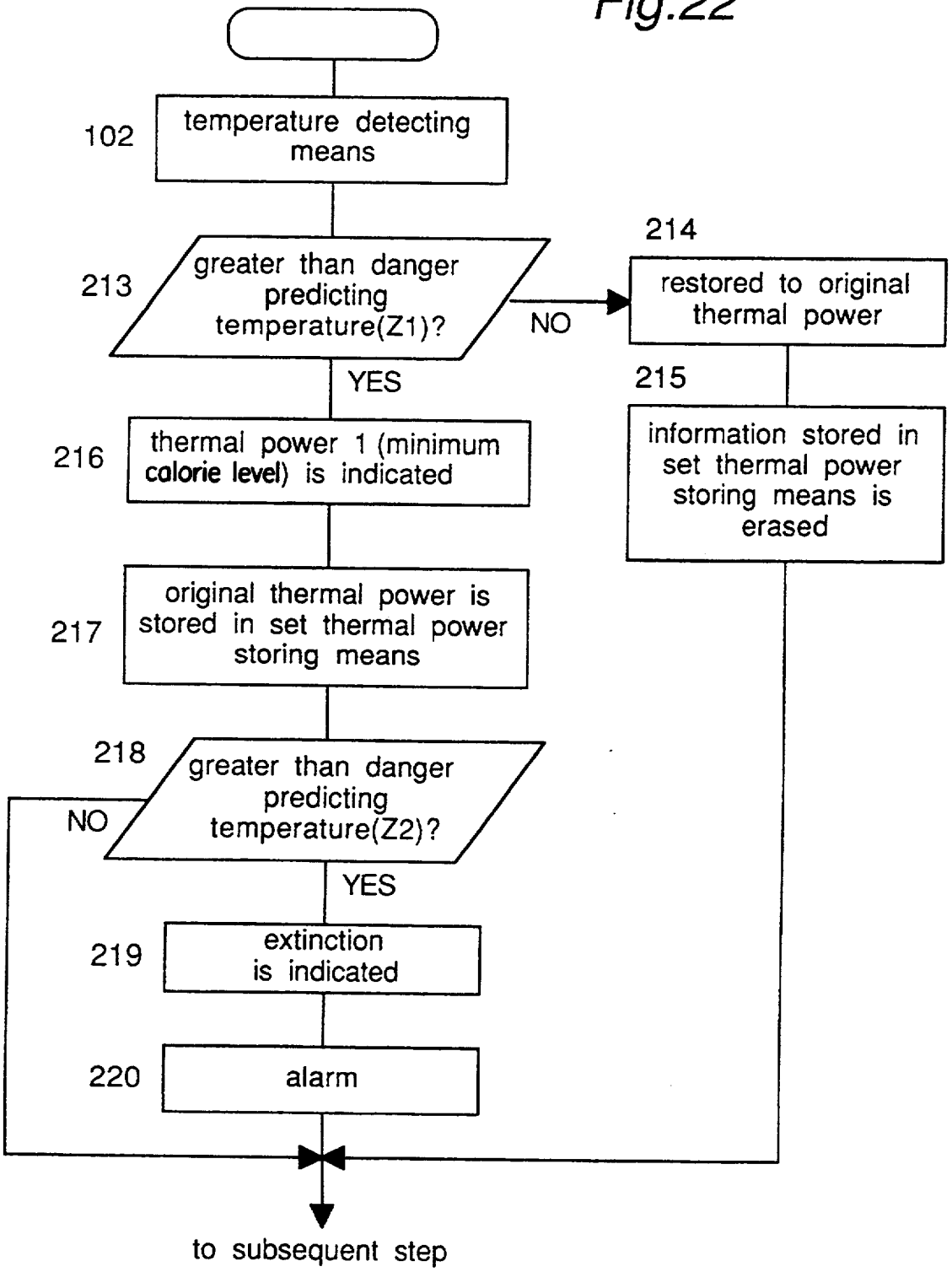
FIG. 22 is a view showing the content of abnormal temperature deciding means.

FIG. 22 shows the content of the abnormal temperature deciding means 96. It is decided at step 213 whether or not a current temperature has become greater than a danger predicting temperature set in advance. If no, the current thermal power is returned to the original thermal power at step 214, and then, the content stored in the set thermal power storing means is erased at step 215, and then the program goes to a subsequent step. If yes, the thermal power is set to the minimum calory at step 216, and then, the original thermal power is stored in the set thermal power storing means at step 217. Then, it is decided at step 218 whether or not the temperature of the temperature detecting means 102 has become greater than the danger predicting temperature. If yes, extinction is instructed at step 219 and an alarm is instructed at step 220, then, the program goes to a subsequent step.

The above-described construction provides the following effects: As shown in FIG. 2, since the main cut-off valve 27 is adopted, the quantity of electric power consumed by the apparatus of the present invention is smaller than that consumed by a conventional apparatus comprising a cut-off valve installed on each flow rate control means, and the manufacturing cost of the former is lower than that of the latter. The main cut-off valve may be of sucking type or holding type (sucking is accomplished by mechanical operation and only holding is possible). If electric current is interrupted, gas can be cut off by the main cut-off valve.

As shown in FIG. 4, since gas is controlled by the geared motor, electric power is used only when thermal power is altered. Therefore, the apparatus is energy-saving, the maintenance cost is low, and the power circuit of the control circuit is manufactured at a low cost. In addition, a plurality of ovens can be controlled respectively and hence electric power fluctuates in a small amount. As a result, a voltage fluctuation is very small in the circuits. Therefore, the apparatus can be reliably used.

As shown in FIG. 4, the flow rate control means comprises the geared motor; the relay joint serving as a switch cam, for converting the rotational motion of the geared motor into a linear reciprocating motion via the serration shaft of the geared motor; the bearing having a spiral slit formed thereon; the shaft making a linear reciprocating motion and having the pin formed on the lower end thereof to be inserted into the bearing; the switch A; and the switch B. Since the relay joint is provided, it is unnecessary to take care in the accuracy of parts or assembling accuracy and in addition, a malfunction rarely occurs. The valve is pressed upward by the shaft which makes a linear reciprocating motion so as to form the flow path of gas. In the stop state shown in FIG. 4, since the geared motor is stopped by means of the switches A and B with a gap formed between the shaft and the valve, gas is reliably cut off and parts are unnecessarily accurate. Further, the switch cam is provided on the relay joint and the combination of the switches A and B makes it possible to distinguish stop, movement, the maximum thermal power, the thermal power adjustable position, and the maximum operational point. Therefore, when service interruption is stopped, the stop position can be immediately recovered. In addition, the minimum flow rate loss position is set in the maximum thermal power state, and it is transmitted to the drive deciding means that thermal power is in the adjustable range. Further, even though the stop position is dislocated and the needle is brought into contact with the needle receiver under pressure, the shock absorbing device stops the geared motor without applying an excessive load thereto. Thus, the gas cooking apparatus can be prevented from malfunctioning.

In the state shown in FIG. 5, the cut-off section has the gap t1 and the gap between the needle and the needle receiver is large. If the gas pressure sensor fails in this state, the maximum flow rate does not change because it is controlled by the main nozzle and moreover, an abnormal burning does not occur.

With the flow of gas, the gas pressure sensor is distorted by gas pressure. The bypass nozzle for controlling the flow rate of gas is provided forward of the gas pressure sensor. Even though the gas pressure sensor is damaged and a slight amount of gas leaks, the pressure of the sensor drops extremely because the flow rate is controlled by the bypass nozzle. Therefore, an abnormal gas pressure can be easily detected. In addition, even though the gas pressure sensor is damaged and there is a possibility that a large amount of gas flows out, gas leaks in a very slight amount because the bypass nozzle regulates the flow rate of gas.

As shown in FIG. 8, the needle portion is not tapered but stepped in the configuration obtained by combining a plurality of cylinders or cones with each other. The flow rate control is adjusted by the combination of an area change and the change in the flow velocity resistance. In other words, a region for adjusting low Wobbe index gas and a region for adjusting high Wobbe index gas are provided. The gas flow rates at the minimum thermal power are different from each other depending on the calorific power of each kind of gas, and the pressure of supplied gas is set depending on kind. Therefore, in the locus of the stroke/gas pressure state of the needle, the minimum gas pressure and the maximum gas pressure exist mixedly in a movable range in which a pressure adjusting stroke is slight, supposing that propane gas is used and the minimum thermal power amount is 400 Kcal/h. As a result, a pressure adjusting value cannot be determined in the correlation between the mechanical accuracy of the driving device and the calculation speed of the gas pressure detecting means. In order to solve this problem, it is necessary to secure a constant stroke range for each kind of gas and in addition form a minimum flow rate regulating opening on the needle receiver so as to control the minimum calory of LPG having the maximum calorific power per volume. In this manner, the needle receiver can be manufactured with a rough finishing and a pressure adjustment can be facilitated. That is, this construction is effective for performing a mass-production.

FIG. 10 shows the content of the gas kind setting means. According to the conventional apparatus, in changing the kind of gas, the gas pressure of the needle, the bypass key, and the governor are altered. As a result, a gas pressure cannot be adjusted as desired, parts are installed erroneously or gas seal cannot be accomplished favorably. In addition, it costs high to replace a large number of parts. Further, the value of the minimum thermal power is changed according to the value of the maximum thermal power. Therefore, the flow rate control means is required depending on the value of the maximum thermal power. For example, in the case of two ovens, 16 kinds of flow rate control means are required in consideration of various kinds of gases. According to the present invention, the kind of gas and calory are set by the change-over of the switch. Thus, only one flow rate control means suffices for the flow rate control. Moreover, it is unnecessary to touch the flow rate control means.

With reference to FIG. 11 showing the content of the thermal power setting means, ignition/extinction adjustment and thermal power adjustment can be accomplished by pressing appropriate keys, and the thermal power is set on the basis of the value of the minimum calory. Therefore, only the minimum calory suitable for a required kind of gas is called to set the thermal power thereof in changing the kind of gas. As a result, a ROM of a small capacity of the microcomputer (central control means) suffices, and the thermal power can be effectively selected with a small amount of manual operation (key pressing).

With reference to FIG. 12 showing the content of the gas pressure deciding means, since a gas pressure correlative to the flow rate of the main nozzle is measured, the thermal power can be controlled. According to the conventional art, when the pressure of supplied gas is minimum, it is necessary to set a calory increased by 40% in 13A gas in order to secure the thermoelectromotive force of the thermocouple used to continue combustion when the pressure of the supplied gas is standard. On the other hand, according to the present invention, the pressure (secondary pressure) of gas in the vicinity of the main nozzle is controlled. Therefore, in gas having 400 Kcal/h at the minimum calory, the present invention allows the minimum gas pressure to be adjusted to a constant value. Thus, the minimum gas pressure can be theoretically reduced to as low as $400\times0.6=240$ Kcal/h. Since an intermediate calory is set on the basis of the gas pressure of the minimum calory, thermal power close to a set thermal power can be obtained even though the pressure of supplied gas fluctuate more or less. As a result, the cooking period of time can be reproduced and a cooking timer can be reliably used. In addition, the apparatus can be adapted for cooking food, for example, an egg which requires a fine calory control. The thermal power is adjusted by adjusting the secondary gas pressure to the set gas pressure corresponding to the set thermal power. Therefore, the gas pressure can be adjusted in a certain pressure range according to the value of the difference between a desired pressure and the secondary pressure. This construction prevents the gas pressure being undetermined for a long period of time. If the pressure difference is greater than a certain value, the drive speed of the flow rate control means 100 is changed according to the value of the pressure difference. If the pressure difference is small, the drive speed thereof is set to be low so as to conform to the desired thermal power. If the pressure difference is large, the drive speed of the flow rate control means 100 is set to be high so that the drive speed thereof reaches the desired thermal power promptly. Accordingly, the thermal power can be reduced for an urgent requirement and in addition when it is necessary to adjust gas pressure in a fine degree, the drive speed of the flow rate control means 100 is made to be low to obtain a desired calory.

With reference to FIGS. 13 and 14 showing the content of the position deciding means and the content of the flow rate control means 100, the control state is decided by the two switches. The bit state of the switch changes by one step so as to check the progress of the program and the failure of the switches. The speed of the flow rate control means 100 is changed according to the difference between the desired destination and the current position so that the flow rate control means 100 reaches the destination promptly and accurately. The moving direction of the driving device is determined depending on whether the difference is positive or negative. Even when the secondary gas pressure at the minimum reduction does not attain a desired adjusted pressure, the driving device is forcibly stopped to prevent the mechanism from being destroyed. When the switch position is at the stop position, the gas pressure sensor is checked. When the switch position is at the maximum thermal power position, the pressure of supplied gas is checked to check on whether the pressure of the supplied gas is abnormal to clarify the switch position.

FIG. 15 shows the content of the means for deciding on the abnormality of supplied gas. The means informs a user of a gas pressure when it becomes less than the pressure provided by the law. The pressure of supplied gas rarely become lower than the pressure provided by the law in a normal condition. When the apparatus is used with a cock of a room half-opened, a rubber pipe twisted or bent, an incomplete combustion occurs, thus causing gas poisoning. According to the present invention, an incomplete combustion is informed by an alarm sound.

With reference to FIG. 16 showing the content of the means 105 for deciding on the compensation of zeroth gas pressure. When the apparatus is not used, the gas pressure sensor is in atmospheric air release state via the main nozzle. Therefore, the secondary gas pressure is measured when the operation of the apparatus is stopped, and an error is discriminated at the time of zeroth gas pressure to make a compensation when the error is below a predetermined range according to the difference between the value of the error and the reference value. In this manner, an error which has occurred in manufacturing the gas pressure sensor can be compensated and incorporated in the apparatus at a low cost. In addition, an error which occurs due to the elapse of time can be minimized and accuracy can be maintained. If the difference between the value of the error and the reference value is great, an alarm is given for inspection. If the difference between the value of the error and the reference value is very great, the apparatus has a function of self-checking of stopping the operation of the apparatus. Thus, the apparatus can be used with reliability and safety.

FIG. 17 shows the content of the means for cutting a high gas pressure. Conventionally, a governor has been used and it is necessary to change the set value of the governor in changing the kind of gas, and due to the loss of flow amount caused by the governor, burning states are differentiated. In addition, there is a problem in setting burning condition and particularly, when an abnormal gas pressure is generated, the apparatus is heated to a very high temperature. The apparatus according to the present invention does not comprise the governor and the burning characteristic of the burner thereof is the same as the conventional one because the secondary gas pressure in the vicinity of the nozzle is adjusted to a constant value without taking a particular consideration, and the thermal power can be adjusted to a constant value with respect to the set thermal power.

With reference to FIG. 17 showing the content of the integrated drive deciding means, the adjustment of thermal power is accomplished by a rough pressure adjustment and a fine pressure adjustment. When a rough pressure adjustment is performed, a plurality of ovens is simultaneously operated. When a fine pressure adjustment is made, the pressures of the ovens are adjusted one by one by stopping the operations of other ovens. In adjusting gas pressure roughly, the thermal power can be reduced promptly for an urgent requirement. In adjusting the gas pressure finely, the processing capability of the microcomputer (central control means) work and pressure sensors are sequentially replaced. Thus, the apparatus costs low and has an accurate function.

With reference to FIG. 19 showing the content of the means for displaying the secondary gas pressure at each burner on the display screen. The display screen displays the remaining period of time of an ordinary cooking and the temperature of the bottom of a pan accommodating oil to be used to fry food. The pressing of an appropriate key allows the display of the secondary gas pressure at each burner. As a result, the capability of the apparatus can be checked without requiring a particular measuring device when it has been manufactured; a measurement preparation can be facilitated only by pressing appropriate keys; convenient for after sales service; and in addition, the period of time for inspection can be reduced.

With reference to FIG. 20 showing the content of the means for deciding on service interruption, electric power is supplied by a back-up power source in order to use the gas cooking apparatus even in service interruption. The back-up power source does not require a large capacity and can be used for a long time. Therefore, the apparatus consumes a minimum electric power and saves energy for the display and the thermal power adjustment.

Figure 23:
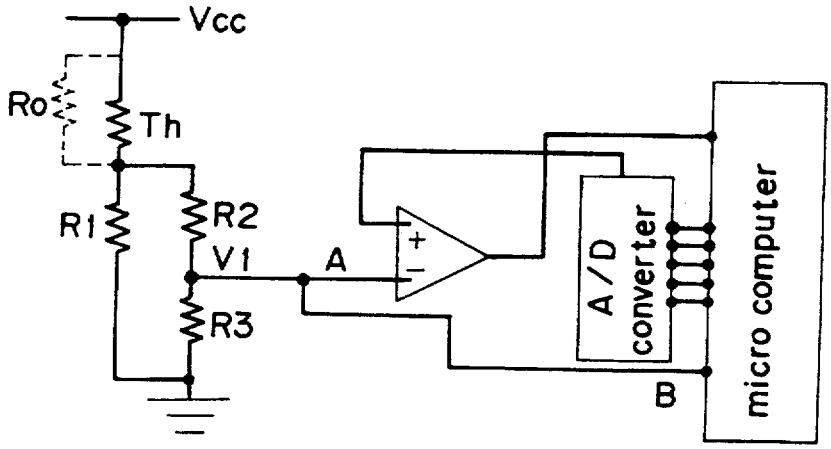
FIG. 23 is a schematic electronic circuit for voltage-converting the resistance change of a temperature sensor.
Figure 24:
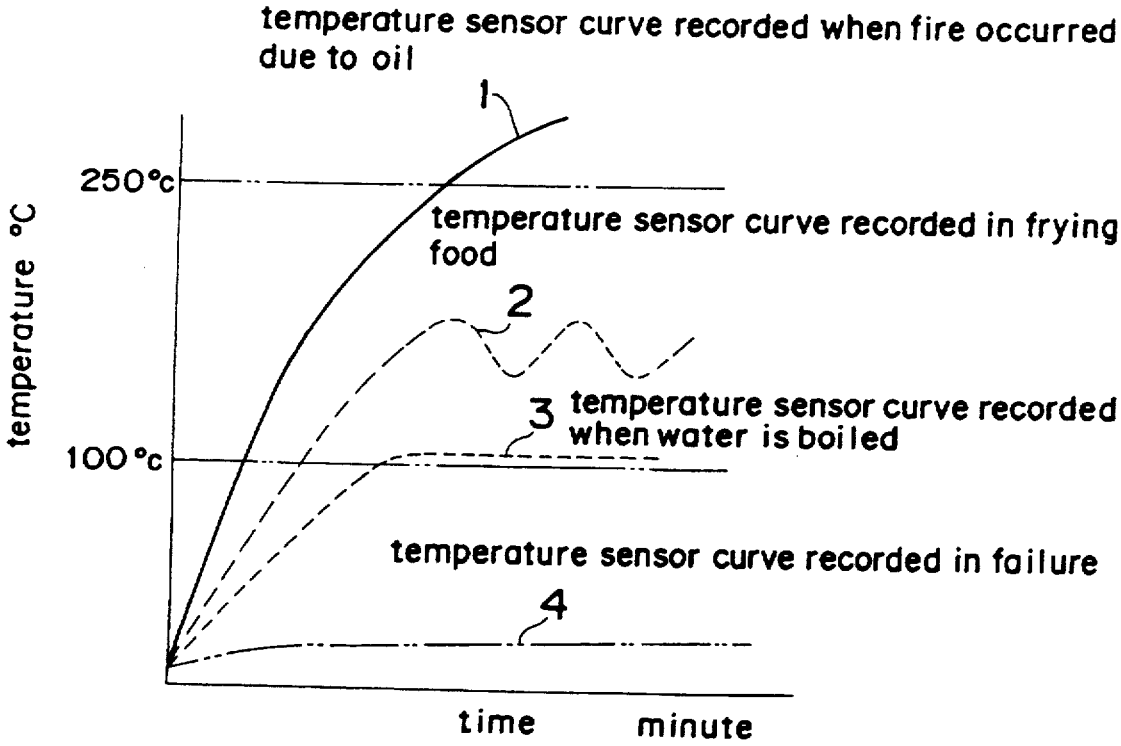
FIG. 24 is a view showing temperatures measured by the temperature sensor when the temperature sensor is normal and abnormal.

FIG. 21 shows the invention regarding the temperature detection to be carried out by the temperature sensor to be used to prevent fire which occurs when the temperature of oil becomes very high in frying food. As shown in FIG. 23, in a control circuit, a signal outputted from the input terminal of the temperature sensor is transmitted to the microcomputer (central control means) via two systems A and B so as to detect a short circuit of the temperature sensor and the open state thereof. Even though one of the input terminals fails, the other input terminal is sensitive to a short circuit for safety. That is, when the voltage at a point V1 is short-circuited and opened, the voltage thereof becomes 0V or Vcc (supply voltage). In this manner, safety is secured in case the sensor fails. But this method is incapable of finding a voltage failure at an intermediate portion of the temperature sensor and the sensor operates in an unsafety side. For example, if a mimic resistance R1 is attached to the temperature sensor, a resistance change becomes slight and the temperature of a pan bottom cannot be accurately detected. In order to solve this problem, it is necessary to detect the state of (4) (temperature of temperature sensor at the time when the unsafe side fails) as shown in FIG. 24. The temperature rise is very low in the curve (4) both in the case of oil and water. But comparing only temperature rise with each other, similar curves are obtained in the case of a high load-applied cooking when the thermal power is minimum. As a result, a nondefective apparatus is regarded as a defective one. In order to solve this problem, two methods are provided by the present invention so as to check whether a certain period of time has elapsed at a maximum thermal power. One method is carried out by the current position deciding means to check whether the maximum thermal power position has been attained. The other method is performed by the gas pressure deciding means to check whether or not the secondary gas pressure corresponding the maximum thermal power has been attained. In addition, whether or not the temperature sensor has become defective is checked based on a temperature and a temperature gradient. In this manner, whether or not the temperature sensor has failed can be reliably detected.

In this embodiment, the pressure sensor is used in the gas cooking apparatus, but the gas burning apparatus according to the present invention can be applied to various gas burning apparatuses such as a gas fan heater and a gas hot-water supply device.

The following effects can be obtained by the gas burning apparatus of the present invention:

The gas pressure deciding means detects the pressure of gas, and the flow rate control means adjusts the gas pressure to an appropriate pressure so that the gas pressure becomes a pressure set by the thermal power setting means. At a set low thermal power in particular, the set thermal power becomes constant. For example, food can be cooked by a weak thermal power about 10 minutes after water is boiled. It is unnecessary to set the minimum thermal power in consideration of the lower limit of the pressure of supplied gas. Therefore, thermal power can be reduced to 300 Kcal/h while conventionally, thermal power is reduced to 400 Kcal/h when a conventional burner is used. In this manner, food can be kept warm. Since the reducing mechanism can be composed of a needle mechanism and a proportional valve, a rapid change does not occur in flame unlike an electromagnetic valve. Thus, the apparatus can be used reliably.

Since the flow rate control device is provided at the gas inflow portion of the pressure detecting section, the amount of gas leakage can be controlled when the pressure detecting section has failed. Further, if gas leaks in a slight amount, an abnormal low gas pressure is indicated. If the pressure detecting section is damaged, there is a possibility that fire occurs in the apparatus as a result of gas leakage. But the flow rate control device prevents gas from leaking in a large amount. If a small amount of gas leaks in the pressure detecting section due to a slight damage thereof, the flow rate control device controls the amount of gas. As a result, the pressure of gas decreases in the pressure detecting section and in addition, the gas pressure deciding means detects a low gas pressure. Thus, an abnormal gas pressure can be detected promptly.

Even though the set gas pressure cannot be attained, the driving means is stopped at the limit point of the movable range of the position deciding means. If dust penetrates into the gas flow rate adjusting section of the flow rate control means and thus thermal power cannot be reduced to a desired amount, the reducing mechanism does not stop gas reducing operation until a predetermined pressure is obtained. At last, the reducing mechanism is decided as defective and thus the operation of the apparatus can be prevented from failing. In addition, an excessively large load is not applied to the reducing mechanism.

If the secondary gas pressure is less than the predetermined pressure of gas at the maximum thermal power position of the thermal power adjusting device, an alarm is given or the apparatus stops burning. In this manner, a low gas pressure is indicated, an alarm is sounded, and burning is not allowed to continue in an unsafe burning state. Further, owing to the information of the low pressure of the supplied gas, a user has an opportunity to examine the reason the pressure of supplied gas is low. As a result, the user may find that the rubber pipe has been bent or the gas cock has been half-opened.

The drive speed of the flow rate control means is varied by the drive speed deciding means. Therefore, when a strong thermal power is changed to a weak thermal power, the flow rate control means is driven fast until thermal power becomes weak. When the gas pressure is finely adjusted to the set gas pressure, the flow rate control means is driven slowly. Thus, thermal power can be reduced rapidly in weakening thermal power after water is boiled. Therefore, in finely adjusting the gas pressure, a slow adjustment is required to prevent flame from being extinguished.

When thermal power is set to the maximum, gas pressure is adjusted to the maximum determined by the limit gas pressure determining means for determining the maximum gas pressure. Therefore, even though the pressure of supplied gas is high, gas pressure is adjusted to the gas pressure corresponding to the maximum thermal power at the standard gas pressure of supplied gas. As a result, the apparatus is not heated excessively and the electronic circuit thereof is not subjected to a very high temperature atmosphere and consequently, a user can use the apparatus without being get burnt and the apparatus can be prevented from failing.

Owing to the gas kind setting means, the burner calory setting means, and the weak (low) calory compensating means, gas pressure can be set according to each kind of gas in adjusting thermal power; and the burning amount of a burner can be changed. For example, in changing the position of a burner of a large calory and that of a burner of an intermediate calory to each other, a set pressure can be altered in conformity to the capability of each burner without changing the construction of the reducing mechanism. That is, in changing the kind of gas, namely, in the change-over of the switch of the gas kind setting means, it is unnecessary to replace the needle of the reducing mechanism unlike the conventional reducing mechanism. Therefore, the number of parts to be replaced can be reduced. In addition, since a gas block is not disassembled, safety can be ensured, and parts replacements can be accomplished in a short period of time. The position of the burner of a large calory and that of the burner of an intermediate calory can be changed to each other by only the change-over of the switch of the gas kind setting means.

The gas kind setting means sets an optimum minimum gas pressure for each kind of gas in conformity to its own combustibleness. Therefore, an optimum minimum gas pressure can be finely set for each kind of gas. Thus, a stable extinguishing performance can be obtained and thermal power is not reduced to an excessive extent.

Owing to the gas pressure deciding/compensating means, an error in measurement due to the atmospheric temperature and aged deterioration can be corrected, and a reference point, obtained when gas has no pressure, can be always corrected. The minimum thermal power of the gas oven is preferably about 400 Kcal/h which is normally used. The gas pressure corresponding to 400 Kcal/h is in the vicinity of 2 $mmH_2O$ although the gas pressure is varied according to the kind of gas. Therefore, the reference point obtained when gas has no pressure is very important. It is always necessary to compensate an error which has occurred due to the atmospheric temperature or aged deterioration so as to measure gas pressure accurately.

Owing to the gas pressure deciding/compensating means, an error in measurement which occurs due to the atmospheric temperature or aged deterioration is alarmed. Therefore, the apparatus can be reliably used by requesting a repair before it fails.

The gas pressure deciding/compensating means is provided. Therefore, if the gas pressure sensing section fails, i.e., if measurement errors often occur due to the atmospheric temperature or aged deterioration, burning state cannot be controlled. Consequently, gas is not burnt for safety.

Since only one gas cut-off function is provided for a plurality of burning apparatuses, electric power is consumed in a small amount and the manufacturing cost is low. A battery may be used because the apparatus consumes a small amount of electric power.

The driving means serves as the driving means of the gas cut-off means. When the cut-off means cuts off gas, the driving means and the cut-off means are spaced from each other. Thus, a small space suffices and the manufacturing cost is low. In addition, in closed state, gas can be reliably cut off because the driving means is not in contact with the cut-off means.

If the difference between a gas pressure set by the thermal power setting means and the secondary gas pressure is less than a certain value in a plurality of burning portions, the pressure difference at each burning portion is adjusted one by one with the operations of remaining burning portions temporarily stopped. Therefore, it is unnecessary that the processing speed of the microcomputer (central control means) is rapid. Since the burning portions are simultaneously operated until a predetermined value is attained, thermal power can be reduced immediately after water is boiled.

Owing to the state display/deciding means, the secondary gas pressure is displayed on the display means by pressing an appropriate key. Thus, inspections can be made without using a specific instrument.

A plurality of cylinders or cones are coaxially formed on the driving member of the reducing mechanism of the flow rate control means. The area of the gap between the cylinders or cones and those formed on a fixed member opposed to the driving member is varied to secure the movable pressure adjusting range of the reducing mechanism for each kind of gas, for example, gas of a low calorific value and gas of a high calorific value. Therefore, thermal power can be reduced easily without repeating operations for reducing and increasing thermal power and making noises unlike the conventional apparatus.

The opening for adjusting the flow rate of LPG to the minimum is provided independently of the reducing mechanism of the flow rate control means. Therefore, even though the reducing mechanism is reduced to the maximum, the minimum flow rate is secured and thus flame is not extinguished.

In the flow rate control means, a shock absorbing device is provided on the reducing mechanism at the limit point of the movable range of the flow rate control means in the minimum reducing direction thereof. In this manner, when thermal power is reduced to the minimum, a shock is applied to the reducing mechanism and the driving device in a reduced degree, which prevents a failure from occurring.

The driving means serves as the driving means of the gas cut-off means. The driving means drives the reducing mechanism and the cut-off means. Therefore, a small space suffices and the manufacturing cost is low.

The drive speed of the flow rate control means is varied by the drive speed deciding means. Therefore, when a strong thermal power is switched to a small thermal power, the drive speed of the flow rate control means is set to be fast until thermal power becomes small. When a fine adjustment is made to move the flow rate control means to the set position, the drive speed thereof is set to be slow. When thermal power is weakened after water is boiled, thermal power can be reduced rapidly. When a fine adjustment is made, thermal power is slowly reduced. Thus, the amount of reciprocating motion is small and flame is not extinguished.

The service interruption deciding means limits a display to be made by the display means or stops the display so as to consume a small amount of electric power. The capacity of the back-up power supply is set to be small and thus the apparatus can be manufactured at a low cost and used for a long period of time.

The position deciding means and the equilibrium temperature deciding means discriminate the defective resistance change of the sensor for detecting the temperature of a pan bottom. That is, these means detect an error made by the sensor. Thus, oil can be prevented from being heated to a very high temperature.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A gas burning apparatus comprising:

a burner means for burning a combustible gas;

a nozzle for supplying combustible gas to the burner means;

a flow rate control means for controlling the amount of the combustible gas to be g-supplied to the nozzle;

a gas pressure detecting means for detecting the pressure of the combustible gas supplied between the flow rate control means and the nozzle;

a thermal power setting means for setting the combustion amount of the combustible gas in the burner means;

a central control means, connected to the thermal power setting means and the gas pressure detecting means, for setting the amount of the combustible gas to be supplied to the burner means to a predetermined value by driving the flow rate control means in response to a signal outputted from the gas pressure detecting means, so that the combustion amount in the burner means corresponds to a burning state set by the thermal power setting means.

2. A gas burning apparatus as defined in claim 1, wherein gas is introduced into a pressure sensing portion of the gas pressure detecting means via a duct disposed between the flow rate control means and the nozzle and via a flow rate restricting portion.

3. A gas burning apparatus as defined in claim 1, wherein the flow rate control means comprises: a reducing means for varying the flow rate of the combustible gas to be supplied to the nozzle; and a driving means for driving the reducing means, so that when a gas pressure detected by the gas pressure detecting means in a state in which the reducing means is closed to the greatest extent does not reach a predetermined position corresponding to a value set by the thermal power setting means, the central control means stops the opening and closing operation of the reducing means to be performed by the driving means at a predetermined closing limit position.

4. A gas burning apparatus as defined in claim 3, wherein said reducing means for performing thermal power adjustment comprises a needle and a needle receiver disposed so as to control the flow rate of gas flowing through a gap therebetween, wherein said needle and needle receiver are provided with a plurality of flow rate control sections for adjusting a flow rate of each of plural kinds of gases having different calorific values in connection with the positional relationship between needle and the needle receiver.

5. A gas burning apparatus as defined in claim 4, wherein an opening for adjusting the flow rate of LPG to minimum is provided independently of the reducing mechanism.

6. A gas burning apparatus as defined in claim 4, further comprising: a driving means for driving the reducing means; and a position detecting means for detecting the limit of the movable range of the reducing means and a current position within the movable range, wherein the reducing means is provided with a shock absorbing device at a limit point of the movable range in a direction in which the flow rate of gas is reduced to a minimum.

7. A gas burning apparatus as defined in claim 4, further comprising: a position detecting means for detecting the limit of the movable range of the reducing means and a current position within the movable range; and a closing means for opening and closing a gas path, wherein the driving means serves as means for driving the reducing means and the closing means.

8. A gas burning apparatus as defined in claim 1, further comprising: a gas kind change-over means for changing the kind of gas to be used; and a position detecting means for detecting a reducing position in a region in which the value of the reducing means of the flow rate control means becomes maximum, wherein when the pressure of gas detected by the gas pressure detecting means is lower than the predetermined gas pressure, the central control means gives an alarm and/or stops the supply of combustible gas to the burner means.

9. A gas burning apparatus as defined in claim 1, wherein the central control means comprises: a drive speed determining means for controlling the drive speed of the driving means so that the drive speed determining means controls the drive speed of the driving means according to the degree of the difference between the predetermined pressure of gas corresponding to a thermal power set by the thermal power setting means and the pressure of gas detected by the gas pressure detecting means.

10. A gas burning apparatus as defined in claim 1, further comprising: a gas kind change-over means, wherein when the pressure of gas detected by the gas pressure detecting means is higher than a maximum gas pressure of a certain kind of gas set by the gas kind change-over means in setting a maximum thermal power by the thermal power setting means, the central control means drives the flow rate control means so as to set the pressure of gas detected by the gas pressure detecting means to the maximum gas pressure set by the gas kind change-over means.

11. A gas burning apparatus as defined in claim 1, further comprising: a burner calorie change-over means for setting a maximum combustion amount corresponding to the combustion performance of each burner so that the central control means corrects the value of gas pressure equivalent to a minimum combustion amount corresponding to the maximum combustion amount of each burner set by the burner calorie change-over means.

12. A gas burning apparatus as defined in claim 1, further comprising: a gas kind change-over means for changing the kind of gas, wherein the central control means decides the kind of gas set by the kind change-over means, and a minimum gas pressure equivalent to a minimum thermal power of the thermal power setting means is set in advance in the central control means depending on the kind of gas.

13. A gas burning apparatus as defined in claim 1, wherein the flow rate control means comprises: a closing means for opening and closing a gas path, and the central control means comprises: a storing means for storing the pressure of gas applied to the gas pressure detecting means if the pressure of gas is within a predetermined value provided that the closing means is in a closed state; and a gas pressure determining/compensating means for altering and correcting a reference value by assuming that the pressure of gas stored in the storing means is at atmospheric pressure.

14. A gas burning apparatus as defined in claim 1, wherein the flow rate control means comprises: a closing means for opening and closing the gas path, and the central control means comprises: a storing means for storing the pressure of gas to be applied to the gas pressure detecting means if the pressure of gas is within a predetermined value provided that the closing means is in a closed state so that an alarm is sounded when the pressure of gas applied to the gas pressure detecting means exceeds a predetermined value provided that the closing means is in a closed state.

15. A gas burning apparatus as defined in claim 1, wherein the flow rate control means comprises: a closing means for opening and closing a gas path, and the central control means comprises: a storing means for storing the pressure of gas applied to the gas pressure detecting means if the pressure of gas is within a predetermined value provided that the closing means is in a closed state so that combustion is stopped when the pressure of gas applied to the gas pressure detecting means exceeds a predetermined value provided that the closing means is in a closed state.

16. A gas burning apparatus, as defined in claim 1, comprising a plurality of burning apparatuses, to which gas is supplied from one gas cut-off valve.

17. A gas burning apparatus as defined in claim 1, wherein the flow rate control means comprises: a reducing means for varying the flow rate of the combustible gas to be supplied to the nozzle; driving means for driving the reducing means; a position detecting means for detecting the limit of the movable range of the reducing means and a current position within the movable range; and a closing means for opening and closing the gas path, the driving means serving as means for driving the reducing means and the closing means; and the driving means and a closing portion of the closing means being spaced from each other when the closing means is closed.

18. A gas burning apparatus, as defined in claim 1, comprising a plurality of burning apparatuses, wherein the flow rate control means of each burning apparatus comprises: a reducing means for varying the flow rate of the combustible gas to be supplied to the nozzle; a driving means for driving the reducing means; a position detecting means for detecting the limit of the movable range of the reducing means and a current position within the movable range; a closing means for opening and closing the gas path;

and wherein the central control means comprises: a drive speed determining means for controlling the drive speed of the driving means of the flow rate control means; and an integrated drive determining means for performing an integrated control over the drive of each of a plurality of the independent flow rate control means;

the integrated drive determining means being operated in a predetermined priority order when the difference between the pressure of gas corresponding to a thermal power set by the thermal power setting means and the pressure of gas supplied by the gas pressure detecting means is detected to be smaller than a predetermined value in the burning operations of a plurality of burning apparatuses.

19. A gas burning apparatus as defined in claim 1, further comprising: a display means for displaying the set state of combustion; and a state display determining means, provided on the central control means, for determining the performance of the gas burning apparatus by operating a specific key so that the state display determining means allows the gas pressure detected by the gas pressure detecting means to be displayed by the display means.

20. A gas burning apparatus comprising:

a burner means for burning combustible gas;

a nozzle for supplying combustible gas to the burner means;

a flow rate control means, for controlling the amount of the combustible gas to be supplied to the nozzle, comprising: a reducing means, for varying the flow rate of combustible gas to be supplied to the nozzle; a driving means for driving the reducing means; and a position detecting means for detecting the limit of the movable range of the reducing means and a current position within the movable range;

a thermal power setting means for setting the combustion amount of the combustible gas in the burner means; and a central control means for driving the flow rate control means by a signal outputted from the position detecting means so as to move the flow rate control means to a reducing position of the reducing means corresponding to a thermal power set by the thermal power setting means, wherein:

the central control means comprises: a drive speed determining means for controlling the drive speed of the driving means according to the distance between a current position in the movable range of the reducing means and a position of the reducing means driven by the driving means from the current position when the thermal power setting means alters thermal power.

21. A gas burning apparatus comprising:

a thermal power setting means for setting the thermal power;

a flow rate control means, having a specified number of flow rate states, for adjusting the thermal power;

a state display determining means for determining the performance of the gas burning apparatus;

a display means for displaying various states including the temperature of a temperature sensor and cooking period of time;

a back-up power supply for supplying power during a service interruption; and a service interruption determining means for limiting or stopping the display of the display means so as to save electric power during service interruption.

22. A gas burning apparatus comprising:

a temperature detecting means for detecting the temperature of a pan bottom;

a burner means for burning combustible gas;

a nozzle for supplying combustible gas to the burner means;

a flow rate control means, for controlling the amount of the combustible gas to be supplied to the nozzle, comprising: a reducing means for varying the flow rate of the combustible gas to be supplied to the nozzle; and driving means for driving the reducing means; and a position detecting means for detecting the limit of the movable range of the reducing means and a current position within the movable range;

a thermal power setting means for setting the combustion amount of the combustible gas in the burner means;

a central control means for driving the flow rate control means to a predetermined position in response to a signal outputted from the position detecting means so that the flow rate control means moves to a reducing position of the reducing means corresponding to a thermal power set by the thermal power setting means;

the central control means comprising: a equilibrium temperature determining means for determining, based on a temperature supplied by the temperature detecting means whether or not a temperature rise gradient is greater than a specified value within a predetermined temperature range and whether or not an equilibrium temperature state has been generated so as to determine if the temperature detecting means has become defective and stop the operation of the gas burning apparatus when the equilibrium temperature determining means has determined that the equilibrium temperature state has been generated and that the position detecting means has determined that the flow rate control means is at a maximum thermal power position.

23. A gas burning apparatus comprising:

a temperature detecting means for detecting the temperature of a pan bottom;

a burner means for burning combustible gas;

a nozzle for supplying combustible gas to the burner means;

a flow rate control means for controlling the amount of the combustible gas to be supplied to the nozzle;

a gas pressure detecting means for detecting the pressure of the combustible gas supplied between the flow rate control means and the nozzle;

a thermal power setting means for setting the combustion amount of the combustible gas in the burner means;

a central control means, connected to the thermal power setting means and the gas pressure detecting means, for setting the amount of the combustible gas to be supplied to the burner means to a predetermined pressure by driving the flow rate control means in response to a signal outputting from the gas pressure detecting means, so that the combustion amount in the burner means corresponds to a burning state set by the thermal power setting means;

the central control means comprising: a equilibrium temperature determining means for determining, based on a temperature supplied by the temperature detecting means whether or not a temperature rise gradient is greater than a specified value within a predetermined temperature range and an equilibrium temperature state has been generated so as to determine if the temperature detecting means has become defective and stop the operation of the gas burning apparatus when the equilibrium temperature determining means has determined that the equilibrium temperature state has been generated and that the secondary gas pressure is greater than a predetermined gas pressure.

* * * * *